US008186963B2

(12) United States Patent
LaMaster et al.

(10) Patent No.: US 8,186,963 B2
(45) Date of Patent: May 29, 2012

(54) AIRFOIL SHAPE FOR COMPRESSOR INLET GUIDE VANE

(75) Inventors: Christopher Edward LaMaster, Simpsonville, SC (US); Venkata Siva P. Chaluvadi, Simpsonville, SC (US); Donald Joseph Kasperski, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 135 days.

(21) Appl. No.: 12/872,160

(22) Filed: Aug. 31, 2010

(65) Prior Publication Data

US 2012/0051927 A1 Mar. 1, 2012

(51) Int. Cl.
*F01D 5/14* (2006.01)

(52) U.S. Cl. ..... 416/223 A; 416/DIG. 5

(58) Field of Classification Search ..... 415/191, 415/208.1, 208.2; 416/223 R, 223 A, DIG. 2, 416/DIG. 5

See application file for complete search history.

(56) References Cited

U.S. PATENT DOCUMENTS

| | | | | |
|---|---|---|---|---|
| 6,543,997 | B2 | 4/2003 | Donnaruma et al. | |
| 7,186,090 | B2 * | 3/2007 | Tomberg et al. | 416/223 A |
| 7,572,105 | B2 | 8/2009 | Columbus et al. | |
| 2007/0231147 | A1 * | 10/2007 | Tomberg et al. | 416/223 R |
| 2008/0101940 | A1 * | 5/2008 | LaMaster et al. | 416/223 R |
| 2008/0101941 | A1 * | 5/2008 | LaMaster et al. | 416/223 R |
| 2008/0101944 | A1 * | 5/2008 | Spracher et al. | 416/223 R |
| 2008/0101945 | A1 * | 5/2008 | Tomberg et al. | 416/223 R |
| 2008/0101949 | A1 * | 5/2008 | Spracher et al. | 416/223 R |
| 2010/0061862 | A1 * | 3/2010 | Bonini et al. | 416/223 R |
| 2010/0068045 | A1 * | 3/2010 | Schott et al. | 415/191 |
| 2010/0092284 | A1 * | 4/2010 | Bonini et al. | 415/208.2 |
| 2012/0051926 | A1 * | 3/2012 | Dutka et al. | 416/223 A |

* cited by examiner

*Primary Examiner* — Igor Kershteyn

(74) *Attorney, Agent, or Firm* — Ernest G. Cusick; Frank A. Landgraff

(57) ABSTRACT

An article of manufacture having a nominal profile substantially in accordance with Cartesian coordinate values of X, Y and Z set forth in TABLE A. X and Y are distances in inches which, when connected by smooth continuing arcs, define airfoil profile sections at each distance Z in inches. The profile sections at the Z distances can be joined smoothly with one another to form a complete inlet guide vane airfoil shape.

6 Claims, 5 Drawing Sheets

AIRFOIL SHAPE FOR COMPRESSOR INLET GUIDE VANE

BACKGROUND OF THE INVENTION

The present invention relates to airfoils for a vane of a gas turbine. In particular, the invention relates to compressor airfoil profiles for an inlet guide vane (IGV).

In a gas turbine, many system requirements should be met at each stage of a gas turbine's flow path section to meet design goals. A turbine hot gas path requires that the compressor airfoil IGV meet design goals and desired requirements of efficiency, reliability, and loading. For example, and in no way limiting of the invention, a IGV of a compressor should achieve thermal and mechanical operating requirements. Further, for example, and in no way limiting of the invention, an IGV of a compressor should achieve thermal and mechanical operating requirements for that particular stage.

Past efforts to meet design goals and desired requirements have provided coatings on the airfoil, but the coatings may not be robust enough or permanent to provide design goals and desired requirements. Accordingly, it is desirable to provide an airfoil configuration, particularly for an IGV, with a profile meet to design goals and desired requirements.

BRIEF DESCRIPTION OF THE INVENTION

In one embodiment of the invention, an article of manufacture comprises an IGV airfoil having an airfoil shape, the airfoil having a nominal profile substantially in accordance with Cartesian coordinate values of X, Y and Z set forth in TABLE A. X and Y are distances which, when connected by smooth continuing arcs, define airfoil profile sections at each distance Z in inches. The profile sections at the Z distances are joined smoothly with one another to form a complete airfoil shape.

In another embodiment according to the invention, an IGV of a compressor includes an airfoil having an uncoated nominal airfoil profile substantially in accordance with Cartesian coordinate values of X, Y and Z set forth in TABLE A. X and Y are distances in inches which, when connected by smooth continuing arcs, define airfoil profile sections at each Z distance in inches. The profile sections at the Z distances are joined smoothly with one another to form a complete airfoil shape. X and Y distances are scalable as a function of a constant to provide a scaled-up or scaled-down airfoil.

In a further embodiment of the invention, an IGV for a compressor comprises a compressor wheel having an IGV. Each IGV has an airfoil shape. The airfoil comprises a nominal profile substantially in accordance with Cartesian coordinate values of X, Y and Z set forth in TABLE A. X and Y are distances in inches which, when connected by smooth continuing arcs, define the airfoil profile sections at each distance Z in inches. The profile sections at the Z distances are joined smoothly with one another to form a complete IGV airfoil shape.

In a yet further embodiment of the invention, a compressor comprises a compressor wheel having an IGV, and each IGV includes an airfoil having an uncoated nominal airfoil profile substantially in accordance with Cartesian coordinate values of X, Y and Z set forth in TABLE A. X and Y are distances which, when connected by smooth continuing arcs, define airfoil profile sections at each distance Z in inches. The profile sections at the Z distances are joined smoothly with one another to form a complete IGV airfoil shape. The X, Y and Z distances are scalable as a function of a constant to provide a scaled-up or scaled-down IGV airfoil.

DETAILED DESCRIPTION OF THE INVENTION

Figure 1:
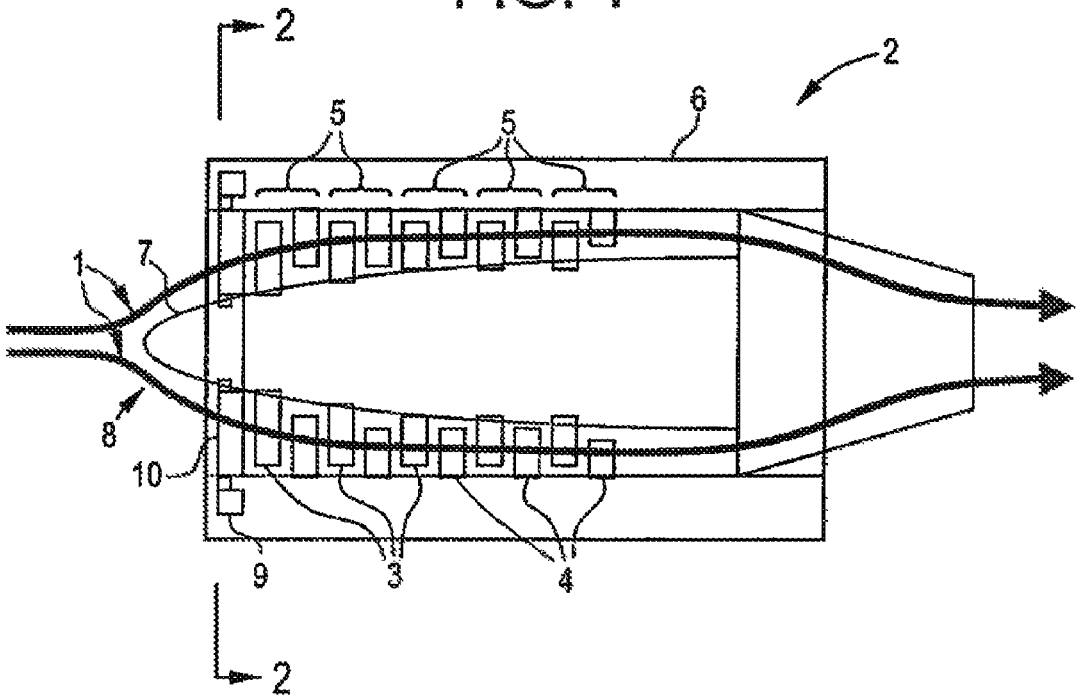
FIG. 1 is a schematic side view of a gas turbine in which an inlet guide vane according to an embodiment of the invention can be used.
Figure 2:
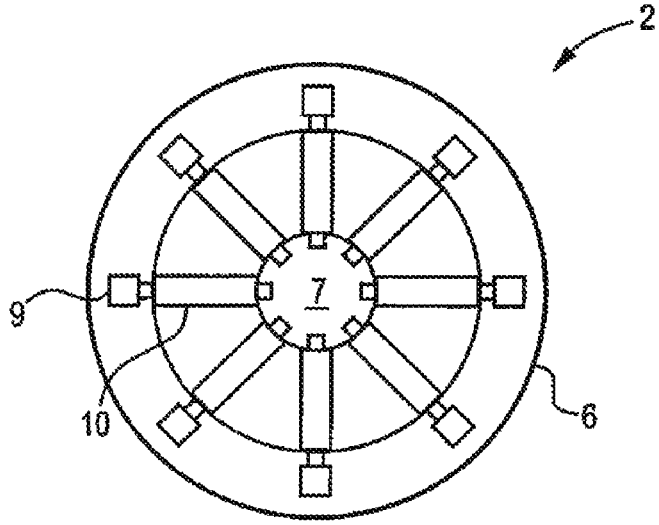
FIG. 2 is a schematic front view of the gas turbine in which an inlet guide vane according to an embodiment of the invention can be used shown in FIG. 1 and taken along the line 2-2.

In accordance with one embodiment of the instant invention, an article of manufacture has a nominal profile substantially in accordance with Cartesian coordinate values of X, Y and Z set forth in TABLE A, and wherein X and Y are distances in inches which, when connected by smooth continuing arcs, define airfoil profile sections at each distance Z in inches, the profile sections at the Z distances being joined smoothly with one another to form a complete IGV airfoil shape.

In accordance with one embodiment of the instant invention, there is provided an airfoil compressor shape for an IGV of a gas turbine that enhances the performance of the gas turbine. The IGV airfoil shape hereof also improves the interaction between various stages of the compressor and affords improved aerodynamic efficiency, while simultaneously reducing stage airfoil thermal and mechanical stresses.

The IGV airfoil profile, as embodied by the invention, is defined by a unique loci of points to achieve the necessary efficiency and loading requirements whereby improved compressor performance is obtained. These unique loci of points define the nominal airfoil IGV profile and are identified by the X, Y and Z Cartesian coordinates of the TABLE A that follows. The points for the coordinate values shown in TABLE A are relative to the engine centerline and for a cold, i.e., room temperature IGV vane at various cross-sections of the vane's airfoil along its length. The positive X, Y and Z directions are axial toward the exhaust end of the turbine, tangential in the direction of engine rotation and radially outwardly toward the static case, respectively. The X, Y, and Z coordinates are given in distance dimensions, e.g., units of inches, and are joined smoothly at each Z location to form a smooth continuous airfoil cross-section. Each defined IGV airfoil section in the X, Y plane is joined smoothly with adjacent airfoil sections in the Z direction to form the complete IGV airfoil shape.

It will be appreciated that an IGV airfoil heats up during use, as known by a person of ordinary skill in the art. The IGV airfoil profile will thus change as a result of mechanical loading and temperature. Accordingly, the cold or room temperature profile, for manufacturing purposes, is given by X, Y and Z coordinates. A distance of plus or minus about 0.160 inches (+/−0.160") from the IGV nominal profile in a direction normal to any surface location along the nominal profile and which includes any coating, defines a profile envelope for this IGV airfoil, because a manufactured IGV airfoil profile may be different from the nominal airfoil profile given by the following table. The IGV airfoil shape is robust to this variation, without impairment of the mechanical and aerodynamic functions of the IGV.

The IGV airfoil, as embodied by the invention, can be scaled up or scaled down geometrically for introduction into similar turbine designs. Consequently, the X, Y and Z coordinates of the nominal IGV airfoil profile may be a function of a constant. That is, the X, Y and Z coordinate values may be multiplied or divided by the same constant or number to provide a "scaled-up" or "scaled-down" version of the IGV airfoil profile, while retaining the IGV airfoil section shape, as embodied by the invention.

With reference to the accompanying FIG.s, examples of an inlet guide vane according to embodiments of the invention are disclosed. For purposes of explanation, numerous specific details are shown in the drawings and set forth in the detailed description that follows in order to provide a thorough understanding of embodiments of the invention. It will be apparent, however, that embodiments of the invention may be practiced without these specific details. In other instances, well-known structures and devices are schematically shown in order to simplify the drawing.

Referring now to the drawings, FIG. 1 illustrates a flow path 1 of a gas turbine 2. The gas turbine 2 includes a compressor including a plurality of airfoils such as, but not limited to, airfoils that are part of alternating rotors 3 and stators 4, each rotor/stator pair 5 comprising a stage of the compressor. The airfoils impart kinetic energy to the airflow and therefore bring about a desired flow across the compressor including a desired pressure rise. Each airfoil has a profile that varies over the length of the blade. The airfoils turn the fluid flow, slow the fluid flow velocity (in the respective airfoil frame of reference), and yield a rise in the static pressure of the fluid flow. The configuration of the airfoil (along with its interaction with surrounding airfoils), as embodied by the invention, including its peripheral surface provides for stage airflow efficiency, enhanced aeromechanics, smooth laminar flow from stage to stage, reduced thermal stresses, enhanced interrelation of the stages to effectively pass the airflow from stage to stage, and reduced mechanical stresses, among other desirable aspects of the invention. Typically, as indicated above, multiple rows of airfoil stages, such as, but not limited to, rotor/stator airfoils, are stacked to achieve a desired discharge to inlet pressure ratio. Airfoils can be secured to wheels or a case by an appropriate attachment configuration, often known as a "root", "base" or "dovetail."

The configuration of the airfoil and any interaction with surrounding airfoils, as embodied by the invention, that provide the desirable aspects fluid flow dynamics and laminar flow of the invention can be determined by various means. For a given airfoil downstream of the inlet guide vanes, fluid flow from a preceding/upstream airfoil intersects with the airfoil, and via the configuration of the instant airfoil, flow over and around the airfoil, as embodied by the invention, is enhanced. In particular, the fluid dynamics and laminar flow from the airfoil, as embodied by the invention, is enhanced. There is a smooth transition fluid flow from the preceding/upstream airfoil(s) and a smooth transition fluid flow to the adjacent/downstream airfoil(s). Moreover, the flow from the airfoil, as embodied by the invention, proceeds to the adjacent/downstream airfoil(s) and is enhanced due to the enhanced laminar fluid flow off of the airfoil, as embodied by the invention. Therefore, the configuration of the airfoil, as embodied by the invention, assists in the prevention of turbulent fluid flow in the unit comprising the airfoil, as embodied by the invention.

For example, but in no way limiting of the invention, the airfoil configuration (with or without fluid flow interaction) can be determined by computational Fluid Dynamics (CFD); traditional fluid dynamics analysis; Euler and Navier-Stokes equations; for transfer functions, algorithms, manufacturing: manual positioning, flow testing (for example in wind tunnels), and modification of the airfoil; in-situ testing; modeling: application of scientific principles to design or develop the airfoils, machines, apparatus, or manufacturing processes; airfoil flow testing and modification; combinations thereof, and other design processes and practices. These methods of determination are merely exemplary, and are not intended to limit the invention in any manner.

As noted above, the airfoil configuration (along with its interaction with surrounding airfoils), as embodied by the invention, including its peripheral surface, provides for stage airflow efficiency, enhanced aeromechanics, smooth laminar flow from stage to stage, reduced thermal stresses, enhanced interrelation of the stages to effectively pass the airflow from stage to stage, and reduced mechanical stresses, among other desirable aspects of the invention, compared to other similar airfoils, which have like applications. Moreover, and in no way limiting of the invention, in conjunction with other airfoils, which are conventional or enhanced (similar to the enhancements herein), the airfoil, as embodied by the invention, provides an increased efficiency compared to previous individual sets of airfoils. This increased efficiency provides, in addition to the above-noted advantages, a power output with a decrease the required fuel, therefore inherently decreasing emissions to produce energy. Of course, other such advantages are within the scope of the invention.

Referring again to FIG. 1, at the inlet 8 of the gas turbine 2, a plurality of inlet guide vanes (IGVs) 10 are arranged about the axis of the gas turbine, spanning at least part of the flow path between the casing 6 and inner barrel or center structure 7. The IGVs 10 condition the airflow by changing its speed and direction in conjunction with the surfaces of the inlet itself. The IGVs 10 are mounted so that their rotational orientation can be changed, such as with an actuator 9, which allows throttling of the gas turbine 2 by varying airflow through the inlet 8 and the rest of the gas turbine 2. Thus, IGVs 10 are mounted in a different manner than rotor and stator blades 3, 4, as is explained below.

Figure 3:
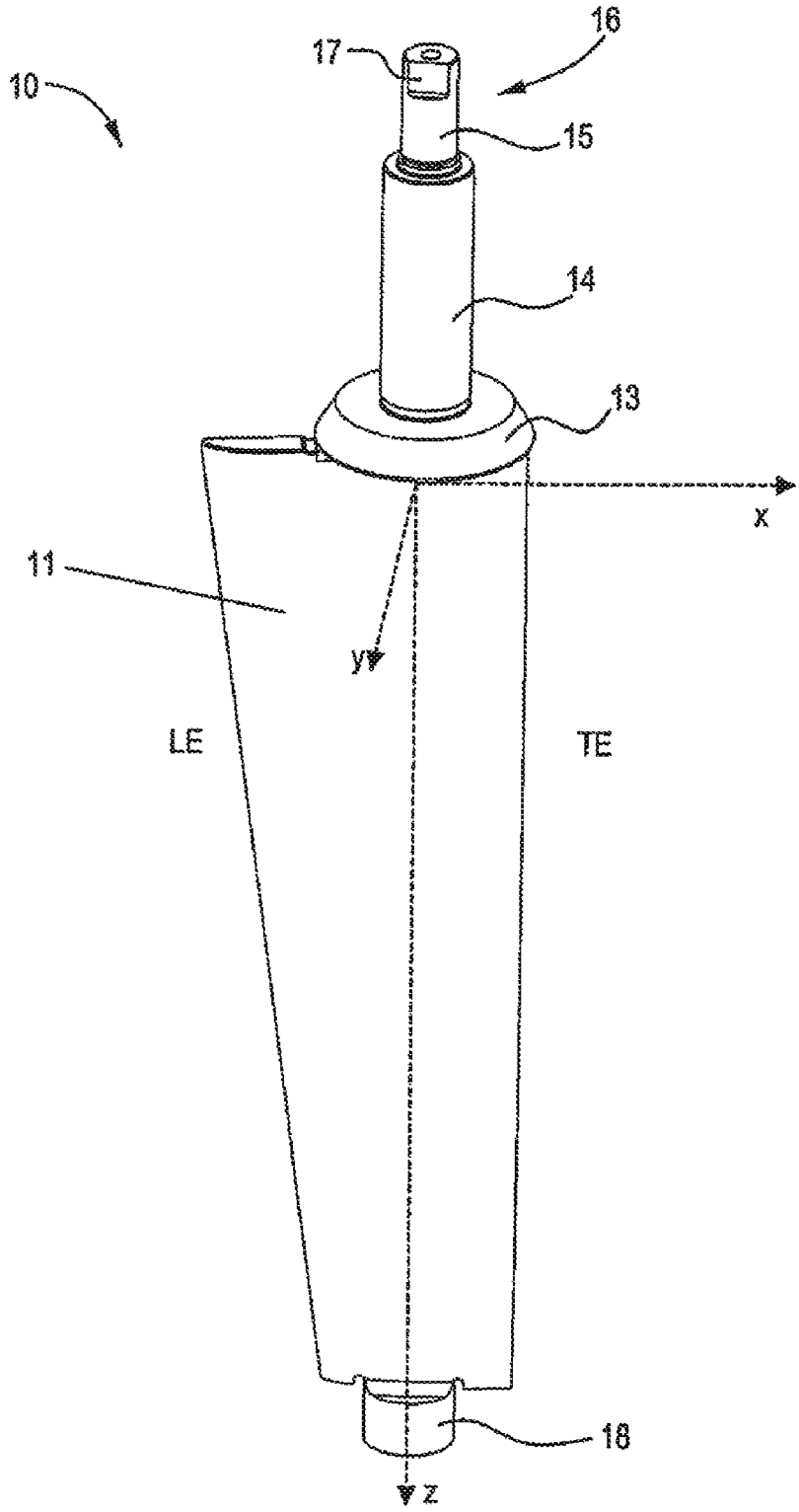
FIG. 3 is a schematic isometric view of an inlet guide vane according to an embodiment of the invention.
Figure 4:
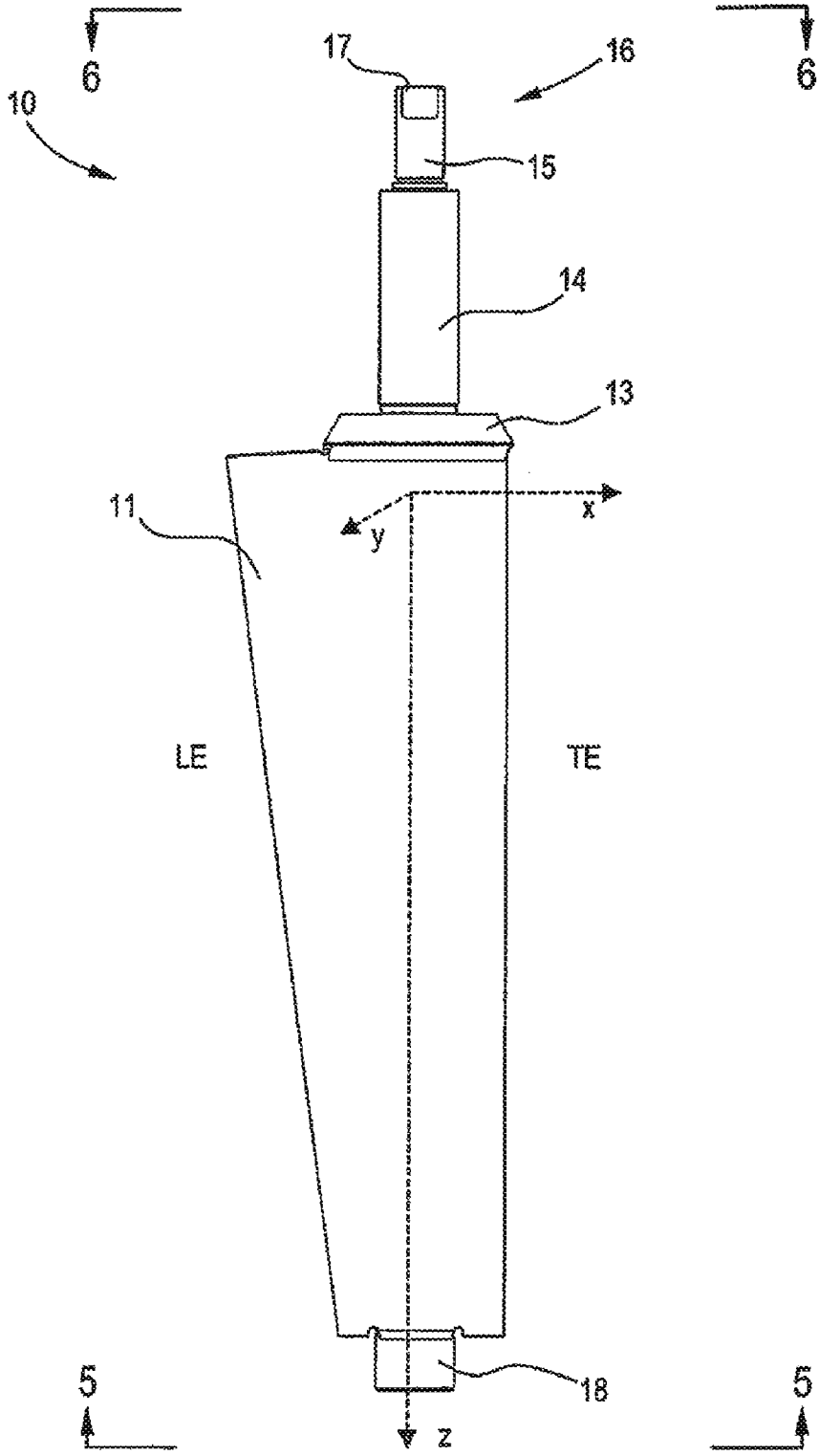
FIG. 4 is a side elevational view of an inlet guide vane according to an embodiment of the invention.
Figure 7:
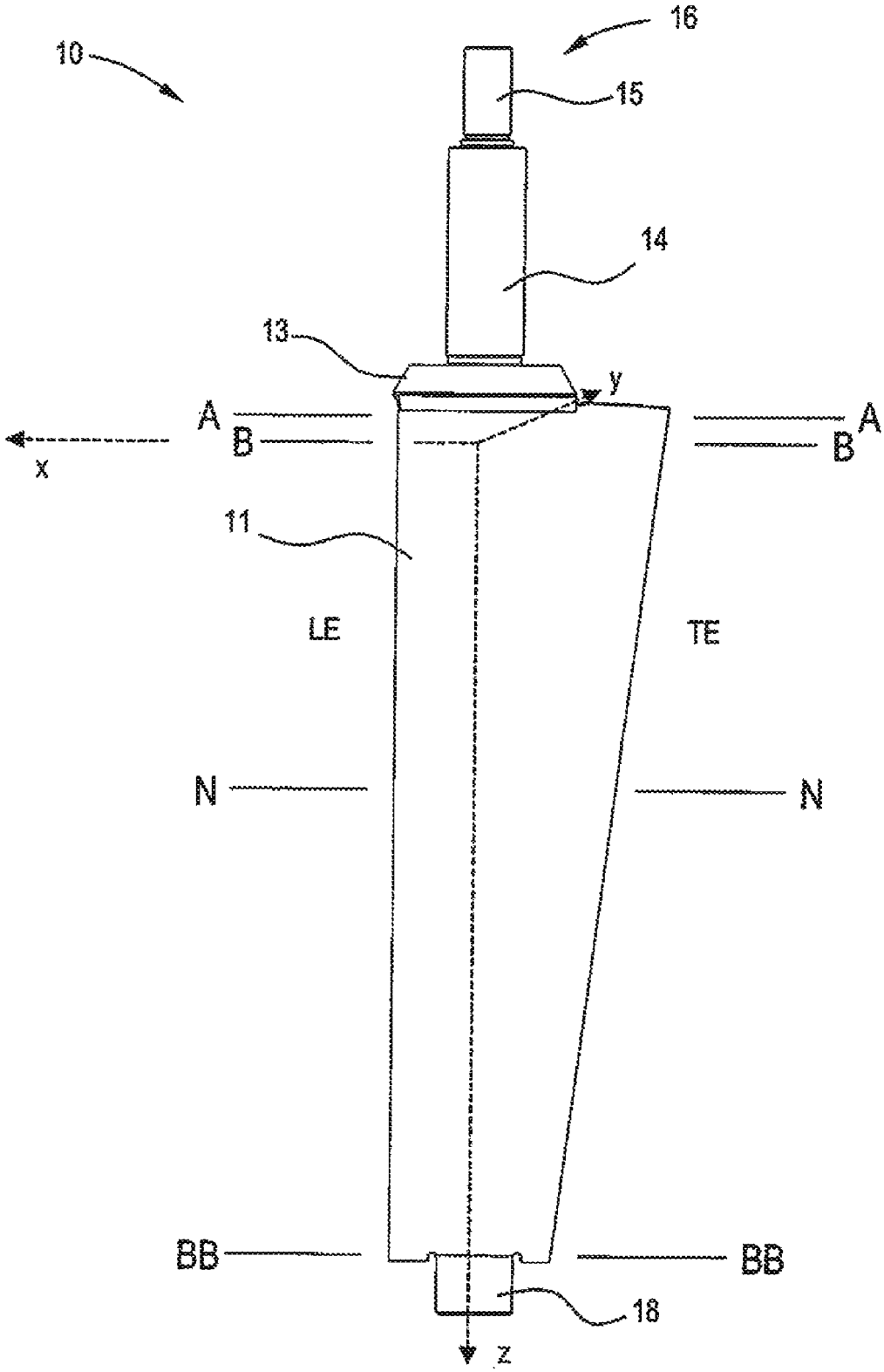
FIG. 7 is a side elevational view of an inlet guide vane according to an embodiment of the invention from the other side of the inlet guide vane of FIG. 4.

With reference to FIGS. 3, 4, and 7, each IGV 10 includes an airfoil 11 whose profile 12 varies along its length as will be described below. At one end of the airfoil is a hub 13 from which projects a top shaft portion 14. The top shaft portion 14 is mounted via a projection 15 in the casing or housing 6 of the gas turbine 2 for rotation about the longitudinal axis z of the top shaft portion. A top end 16 of the projection includes a feature 17, such as a flattened portion, that enables manipulation of the projection 15 and the top shaft portion 14. An actuator 9 interacts with the feature 17 of the projection 15 to change the rotational position of the top shaft portion 14 and the IGV 10. At the other end of the IGV 10 is a bottom shaft portion 18 that is coaxial with the top shaft portion 14. The bottom shaft portion 18 is mounted for rotation about its longitudinal axis z in the inlet portion of the center structure 7.

Figure 5:
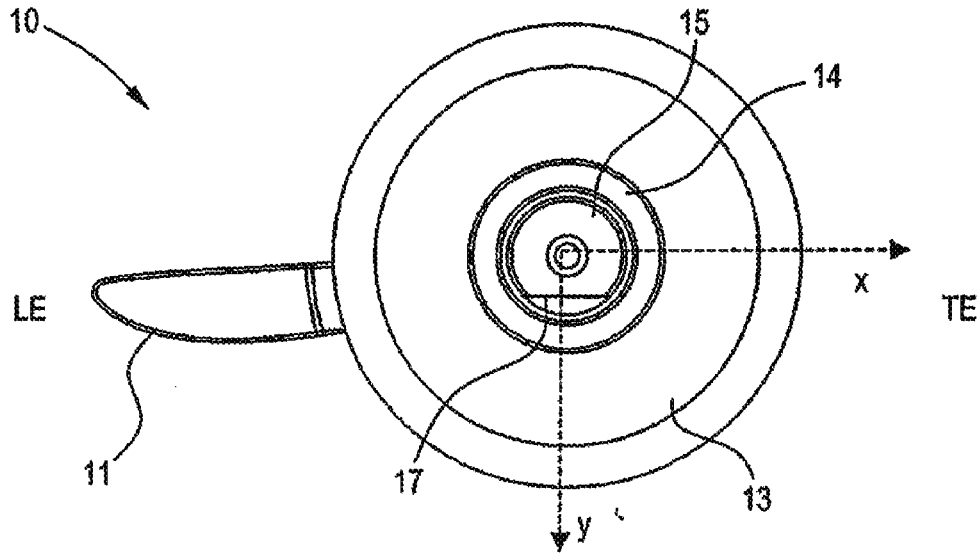
FIGS. 5 and 6 are respective top and bottom elevational views of the inlet guide vane of FIG. 4.
Figure 6:
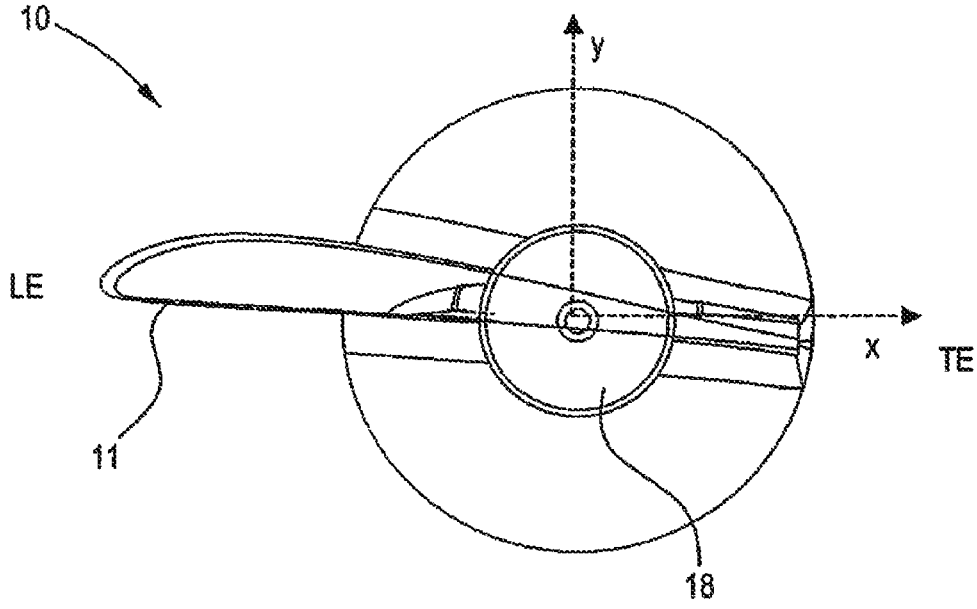

As can particularly be seen in FIGS. 5 and 6, each IGV 10 is an airfoil 11 with a varying profile 12. At the top, the airfoil 11 is thicker and longer than it is at the bottom, and the angle of attack changes along the length of the IGV 10. FIG. 8 shows the profile of an IGV of an embodiment as it appears at specific cross sections A-A, B-B, N-N, and BB-BB of the IGV 10 as seen in FIG. 7.

To define the airfoil shape or profile 12 of the IGV 10, a unique set of points in space were derived by analytical means, such as by iteration of mechanical and aerodynamic loadings and flow conditions in a modeling computer software application. More specifically, to define the airfoil profiles 12 of the IGV 10, a unique set of points in space were derived using modeling computer software at respective spanwise positions on the blade. Local inflow distortions at each spanwise position were considered and each profile was derived with the goals of minimizing total pressure drop, broadening the separation-free range of operation vs. angle of attack to match the predicted inflow distortion, and satisfying mechanical requirements for strength, vibrational stress, and ease of manufacture. The profiles are interpolated to define the entire blade surface. This process is carried out in a computer software environment, such as a proprietary computer software environment. Fully three-dimensional computer analyses and scale model testing of the combined IGV and engine inlet were conducted to validate the design. The unique set of points is described using the Cartesian coordinate system of three mutually perpendicular axes x, y, and z. An example unique set of points is set forth in TABLE A below and is sufficient to enable manufacture of the IGV 10, such as with a "CNC" machine or other suitable apparatus, or by another method, such as casting, for example. Producing an IGV following the unique set of points yields an IGV that drives the initiation of flow separation from the IGVs to lower flow conditions than previous IGVs. As a result, vibration resulting from flow separation is significantly reduced, increasing reliability and reducing vibration-induced stresses on the IGVs and other components of the gas turbine.

The compressor vanes, including an IGV, impart kinetic energy to the airflow and therefore bring about a desired pressure rise. Directly following IGV, rotor airfoils and a stage of stator airfoils are provided. Both the rotor and stator airfoils turn the airflow, slow the airflow velocity (in the respective airfoil frame of reference), and yield a rise in the static pressure of the airflow. Typically, multiple rows of rotor/stator stages are stacked in axial flow compressors to achieve a desired discharge to inlet pressure ratio. Rotor and stator airfoils can be secured to rotor wheels or stator case by an appropriate attachment configuration, often known as a "root", "base" or "dovetail" (see FIGS. 2-5).

The instant invention is directed to an inlet guide vane (IGV) airfoil shape. Inlet guide vanes (IGVs) modulate flow to the first stage, usually a first rotor stage, of the compressor. A variety of parameters define the shape and position of each IGV in a compressor. These parameters include but are not limited to the meanline of the IGV profile; the thickness distribution of the IGV profile; the lift coefficient, which is a multiplier of the meanline; and the stagger angle, which is the angle of the IGV relative to the axial direction of the compressor. By varying the IGV parameters, multiple IGV profile and stagger angle combinations are possible for any given IGV exit condition, the IGV exit condition being the angle at which a gas, usually air, exits the IGV.

To define the airfoil shape of the IGV airfoil, a unique set or loci of points in space are provided. This unique set or loci of points meet the stage requirements so the IGV can be manufactured. This unique loci of points also meets the desired requirements for stage efficiency and reduced thermal and mechanical stresses. The loci of points are arrived at by iteration between aerodynamic and mechanical loadings enabling the compressor to run in an efficient, safe and smooth manner.

The loci, as embodied by the invention, defines the IGV airfoil profile and can comprise a set of points relative to the axis of rotation of the engine. For example, a set of points can be provided to define an IGV airfoil profile. Furthermore, the vane airfoil profile, as embodied by the invention, can comprise an IGV of a compressor.

A Cartesian coordinate system of X, Y and Z values given in TABLE A below defines a profile of an IGV airfoil at various locations along its length. The coordinate values for the X, Y and Z coordinates are set forth in inches, although other units of dimensions may be used when the values are appropriately converted. These values exclude fillet regions of the platform. The Cartesian coordinate system has orthogonally-related X, Y and Z axes. The X axis lies parallel to the compressor rotor centerline, such as the rotary axis. A positive X coordinate value is axial toward the aft, for example the exhaust end of the compressor. A positive Y coordinate value directed aft extends tangentially in the direction of rotation of the rotor. A positive Z coordinate value is directed radially outward toward the static casing of the compressor.

TABLE A values are generated and shown to three decimal places for determining the profile of an IGV airfoil. There are typical manufacturing tolerances as well as coatings, which should be accounted for in the actual profile of an IGV. Accordingly, the values for the profile given are for a nominal IGV airfoil. It will therefore be appreciated that +/− typical manufacturing tolerances, such as, +/−values, including any coating thicknesses, are additive to the X and Y values. Therefore, a distance of about +/−0.160 inches in a direction normal to any surface location along the IGV airfoil profile defines an IGV airfoil profile envelope for a vane airfoil design and compressor. In other words, a distance of about +/−0.160 inches in a direction normal to any surface location along an IGV profile defines a range of variation between measured points on the actual an IGV airfoil surface at nominal cold or room temperature and the ideal position of those points, at the same temperature, as embodied by the invention. The IGV airfoil design, as embodied by the invention, is robust to this range of variation without impairment of mechanical and aerodynamic functions.

The coordinate values given in the TABLE A below provide the nominal profile envelope for an exemplary an IGV.

TABLE A

| X | Y | Z |
|---|---|---|
| −3.8515 | 0.5190 | −1.0653 |
| −3.8512 | 0.5173 | −1.0653 |
| −3.8504 | 0.5139 | −1.0653 |
| −3.8483 | 0.5072 | −1.0653 |
| −3.8428 | 0.4944 | −1.0653 |
| −3.8306 | 0.4763 | −1.0653 |
| −3.8017 | 0.4498 | −1.0653 |
| −3.7560 | 0.4248 | −1.0653 |
| −3.6901 | 0.4040 | −1.0653 |
| −3.6056 | 0.3892 | −1.0653 |
| −3.4946 | 0.3755 | −1.0653 |
| −3.3663 | 0.3612 | −1.0653 |
| −3.2293 | 0.3472 | −1.0653 |
| −3.0752 | 0.3319 | −1.0653 |
| −2.9039 | 0.3145 | −1.0653 |
| −2.7157 | 0.2944 | −1.0653 |
| −2.5191 | 0.2719 | −1.0653 |
| −2.3142 | 0.2469 | −1.0653 |
| −2.1011 | 0.2190 | −1.0653 |
| −1.8800 | 0.1878 | −1.0653 |
| −1.6508 | 0.1530 | −1.0653 |
| −1.4135 | 0.1149 | −1.0653 |
| −1.1682 | 0.0731 | −1.0653 |
| −0.9150 | 0.0269 | −1.0653 |
| −0.6624 | −0.0229 | −1.0653 |
| −0.4106 | −0.0762 | −1.0653 |
| −0.1594 | −0.1327 | −1.0653 |

TABLE A-continued

| X | Y | Z |
|---|---|---|
| 0.0912 | −0.1922 | −1.0653 |
| 0.3413 | −0.2547 | −1.0653 |
| 0.5908 | −0.3199 | −1.0653 |
| 0.8398 | −0.3875 | −1.0653 |
| 1.0883 | −0.4574 | −1.0653 |
| 1.3362 | −0.5293 | −1.0653 |
| 1.5835 | −0.6031 | −1.0653 |
| 1.8301 | −0.6791 | −1.0653 |
| 2.0677 | −0.7549 | −1.0653 |
| 2.2964 | −0.8306 | −1.0653 |
| 2.5162 | −0.9060 | −1.0653 |
| 2.7270 | −0.9810 | −1.0653 |
| 2.9288 | −1.0555 | −1.0653 |
| 3.1217 | −1.1294 | −1.0653 |
| 3.3056 | −1.2025 | −1.0653 |
| 3.4727 | −1.2713 | −1.0653 |
| 3.6233 | −1.3352 | −1.0653 |
| 3.7573 | −1.3939 | −1.0653 |
| 3.8751 | −1.4470 | −1.0653 |
| 3.9766 | −1.4941 | −1.0653 |
| 4.0620 | −1.5349 | −1.0653 |
| 4.1347 | −1.5705 | −1.0653 |
| 4.1956 | −1.6008 | −1.0653 |
| 4.2456 | −1.6259 | −1.0653 |
| 4.2855 | −1.6462 | −1.0653 |
| 4.3180 | −1.6572 | −1.0653 |
| 4.3438 | −1.6544 | −1.0653 |
| 4.3632 | −1.6447 | −1.0653 |
| 4.3759 | −1.6329 | −1.0653 |
| 4.3833 | −1.6220 | −1.0653 |
| 4.3886 | −1.6096 | −1.0653 |
| 4.3918 | −1.5919 | −1.0653 |
| 4.3891 | −1.5695 | −1.0653 |
| 4.3764 | −1.5458 | −1.0653 |
| 4.3476 | −1.5244 | −1.0653 |
| 4.3070 | −1.5007 | −1.0653 |
| 4.2563 | −1.4712 | −1.0653 |
| 4.1947 | −1.4352 | −1.0653 |
| 4.1215 | −1.3921 | −1.0653 |
| 4.0360 | −1.3415 | −1.0653 |
| 3.9353 | −1.2811 | −1.0653 |
| 3.8193 | −1.2111 | −1.0653 |
| 3.6880 | −1.1316 | −1.0653 |
| 3.5412 | −1.0426 | −1.0653 |
| 3.3789 | −0.9444 | −1.0653 |
| 3.2009 | −0.8373 | −1.0653 |
| 3.0147 | −0.7264 | −1.0653 |
| 2.8200 | −0.6121 | −1.0653 |
| 2.6168 | −0.4951 | −1.0653 |
| 2.4046 | −0.3761 | −1.0653 |
| 2.1833 | −0.2555 | −1.0653 |
| 1.9524 | −0.1343 | −1.0653 |
| 1.7117 | −0.0133 | −1.0653 |
| 1.4687 | 0.1027 | −1.0653 |
| 1.2234 | 0.2134 | −1.0653 |
| 0.9755 | 0.3185 | −1.0653 |
| 0.7252 | 0.4179 | −1.0653 |
| 0.4723 | 0.5115 | −1.0653 |
| 0.2166 | 0.5989 | −1.0653 |
| −0.0420 | 0.6797 | −1.0653 |
| −0.3038 | 0.7533 | −1.0653 |
| −0.5682 | 0.8192 | −1.0653 |
| −0.8341 | 0.8766 | −1.0653 |
| −1.1018 | 0.9246 | −1.0653 |
| −1.3624 | 0.9610 | −1.0653 |
| −1.6157 | 0.9854 | −1.0653 |
| −1.8595 | 0.9986 | −1.0653 |
| −2.0935 | 1.0015 | −1.0653 |
| −2.3178 | 0.9949 | −1.0653 |
| −2.5324 | 0.9799 | −1.0653 |
| −2.7375 | 0.9573 | −1.0653 |
| −2.9330 | 0.9272 | −1.0653 |
| −3.1102 | 0.8927 | −1.0653 |
| −3.2691 | 0.8552 | −1.0653 |
| −3.4097 | 0.8144 | −1.0653 |
| −3.5393 | 0.7690 | −1.0653 |
| −3.6502 | 0.7258 | −1.0653 |
| −3.7336 | 0.6881 | −1.0653 |

TABLE A-continued

| X | Y | Z |
|---|---|---|
| −3.7939 | 0.6472 | −1.0653 |
| −3.8304 | 0.6061 | −1.0653 |
| −3.8482 | 0.5691 | −1.0653 |
| −3.8528 | 0.5466 | −1.0653 |
| −3.8531 | 0.5319 | −1.0653 |
| −3.8524 | 0.5245 | −1.0653 |
| −3.8519 | 0.5209 | −1.0653 |
| −3.7666 | 0.4810 | 0.0000 |
| −3.7663 | 0.4793 | 0.0000 |
| −3.7655 | 0.4760 | 0.0000 |
| −3.7635 | 0.4695 | 0.0000 |
| −3.7580 | 0.4570 | 0.0000 |
| −3.7459 | 0.4395 | 0.0000 |
| −3.7174 | 0.4140 | 0.0000 |
| −3.6724 | 0.3902 | 0.0000 |
| −3.6079 | 0.3707 | 0.0000 |
| −3.5249 | 0.3569 | 0.0000 |
| −3.4160 | 0.3439 | 0.0000 |
| −3.2901 | 0.3303 | 0.0000 |
| −3.1558 | 0.3168 | 0.0000 |
| −3.0046 | 0.3020 | 0.0000 |
| −2.8367 | 0.2850 | 0.0000 |
| −2.6522 | 0.2652 | 0.0000 |
| −2.4594 | 0.2430 | 0.0000 |
| −2.2586 | 0.2182 | 0.0000 |
| −2.0498 | 0.1905 | 0.0000 |
| −1.8330 | 0.1596 | 0.0000 |
| −1.6083 | 0.1253 | 0.0000 |
| −1.3756 | 0.0878 | 0.0000 |
| −1.1350 | 0.0468 | 0.0000 |
| −0.8866 | 0.0014 | 0.0000 |
| −0.6388 | −0.0473 | 0.0000 |
| −0.3917 | −0.0995 | 0.0000 |
| −0.1452 | −0.1548 | 0.0000 |
| 0.1009 | −0.2130 | 0.0000 |
| 0.3464 | −0.2740 | 0.0000 |
| 0.5914 | −0.3377 | 0.0000 |
| 0.8357 | −0.4039 | 0.0000 |
| 1.0793 | −0.4724 | 0.0000 |
| 1.3223 | −0.5431 | 0.0000 |
| 1.5646 | −0.6159 | 0.0000 |
| 1.8063 | −0.6908 | 0.0000 |
| 2.0392 | −0.7657 | 0.0000 |
| 2.2633 | −0.8403 | 0.0000 |
| 2.4787 | −0.9147 | 0.0000 |
| 2.6854 | −0.9885 | 0.0000 |
| 2.8832 | −1.0617 | 0.0000 |
| 3.0724 | −1.1341 | 0.0000 |
| 3.2528 | −1.2056 | 0.0000 |
| 3.4168 | −1.2728 | 0.0000 |
| 3.5646 | −1.3351 | 0.0000 |
| 3.6962 | −1.3923 | 0.0000 |
| 3.8118 | −1.4440 | 0.0000 |
| 3.9115 | −1.4898 | 0.0000 |
| 3.9955 | −1.5295 | 0.0000 |
| 4.0669 | −1.5641 | 0.0000 |
| 4.1268 | −1.5935 | 0.0000 |
| 4.1759 | −1.6180 | 0.0000 |
| 4.2151 | −1.6377 | 0.0000 |
| 4.2469 | −1.6488 | 0.0000 |
| 4.2725 | −1.6464 | 0.0000 |
| 4.2918 | −1.6370 | 0.0000 |
| 4.3044 | −1.6253 | 0.0000 |
| 4.3117 | −1.6145 | 0.0000 |
| 4.3168 | −1.6023 | 0.0000 |
| 4.3197 | −1.5848 | 0.0000 |
| 4.3166 | −1.5630 | 0.0000 |
| 4.3037 | −1.5400 | 0.0000 |
| 4.2753 | −1.5194 | 0.0000 |
| 4.2354 | −1.4966 | 0.0000 |
| 4.1856 | −1.4680 | 0.0000 |
| 4.1252 | −1.4332 | 0.0000 |
| 4.0533 | −1.3916 | 0.0000 |
| 3.9695 | −1.3426 | 0.0000 |
| 3.8706 | −1.2843 | 0.0000 |
| 3.7567 | −1.2166 | 0.0000 |
| 3.6278 | −1.1397 | 0.0000 |
| 3.4838 | −1.0537 | 0.0000 |

TABLE A-continued

| X | Y | Z |
|---|---|---|
| 3.3245 | −0.9588 | 0.0000 |
| 3.1498 | −0.8553 | 0.0000 |
| 2.9670 | −0.7481 | 0.0000 |
| 2.7760 | −0.6378 | 0.0000 |
| 2.5767 | −0.5248 | 0.0000 |
| 2.3688 | −0.4099 | 0.0000 |
| 2.1520 | −0.2934 | 0.0000 |
| 1.9260 | −0.1762 | 0.0000 |
| 1.6906 | −0.0590 | 0.0000 |
| 1.4532 | 0.0537 | 0.0000 |
| 1.2139 | 0.1614 | 0.0000 |
| 0.9724 | 0.2640 | 0.0000 |
| 0.7287 | 0.3612 | 0.0000 |
| 0.4826 | 0.4528 | 0.0000 |
| 0.2341 | 0.5385 | 0.0000 |
| −0.0171 | 0.6176 | 0.0000 |
| −0.2712 | 0.6899 | 0.0000 |
| −0.5283 | 0.7547 | 0.0000 |
| −0.7887 | 0.8119 | 0.0000 |
| −1.0521 | 0.8603 | 0.0000 |
| −1.3081 | 0.8973 | 0.0000 |
| −1.5564 | 0.9230 | 0.0000 |
| −1.7969 | 0.9378 | 0.0000 |
| −2.0289 | 0.9427 | 0.0000 |
| −2.2512 | 0.9382 | 0.0000 |
| −2.4637 | 0.9252 | 0.0000 |
| −2.6665 | 0.9046 | 0.0000 |
| −2.8597 | 0.8765 | 0.0000 |
| −3.0346 | 0.8436 | 0.0000 |
| −3.1913 | 0.8074 | 0.0000 |
| −3.3294 | 0.7684 | 0.0000 |
| −3.4567 | 0.7255 | 0.0000 |
| −3.5652 | 0.6826 | 0.0000 |
| −3.6462 | 0.6443 | 0.0000 |
| −3.7055 | 0.6045 | 0.0000 |
| −3.7427 | 0.5654 | 0.0000 |
| −3.7620 | 0.5300 | 0.0000 |
| −3.7674 | 0.5081 | 0.0000 |
| −3.7681 | 0.4937 | 0.0000 |
| −3.7675 | 0.4864 | 0.0000 |
| −3.7670 | 0.4828 | 0.0000 |
| −3.7321 | 0.4656 | 0.4347 |
| −3.7317 | 0.4639 | 0.4347 |
| −3.7309 | 0.4606 | 0.4347 |
| −3.7289 | 0.4541 | 0.4347 |
| −3.7234 | 0.4418 | 0.4347 |
| −3.7114 | 0.4244 | 0.4347 |
| −3.6829 | 0.3994 | 0.4347 |
| −3.6382 | 0.3761 | 0.4347 |
| −3.5741 | 0.3571 | 0.4347 |
| −3.4917 | 0.3437 | 0.4347 |
| −3.3836 | 0.3309 | 0.4347 |
| −3.2588 | 0.3176 | 0.4347 |
| −3.1255 | 0.3044 | 0.4347 |
| −2.9756 | 0.2898 | 0.4347 |
| −2.8090 | 0.2729 | 0.4347 |
| −2.6259 | 0.2532 | 0.4347 |
| −2.4348 | 0.2311 | 0.4347 |
| −2.2356 | 0.2064 | 0.4347 |
| −2.0285 | 0.1787 | 0.4347 |
| −1.8135 | 0.1479 | 0.4347 |
| −1.5905 | 0.1138 | 0.4347 |
| −1.3597 | 0.0766 | 0.4347 |
| −1.1210 | 0.0359 | 0.4347 |
| −0.8745 | −0.0091 | 0.4347 |
| −0.6287 | −0.0575 | 0.4347 |
| −0.3835 | −0.1092 | 0.4347 |
| −0.1388 | −0.1640 | 0.4347 |
| 0.1054 | −0.2216 | 0.4347 |
| 0.3490 | −0.2821 | 0.4347 |
| 0.5921 | −0.3451 | 0.4347 |
| 0.8345 | −0.4106 | 0.4347 |
| 1.0761 | −0.4785 | 0.4347 |
| 1.3171 | −0.5486 | 0.4347 |
| 1.5574 | −0.6209 | 0.4347 |
| 1.7970 | −0.6956 | 0.4347 |
| 2.0280 | −0.7701 | 0.4347 |
| 2.2502 | −0.8444 | 0.4347 |

TABLE A-continued

| X | Y | Z |
|---|---|---|
| 2.4638 | −0.9184 | 0.4347 |
| 2.6687 | −0.9918 | 0.4347 |
| 2.8650 | −1.0644 | 0.4347 |
| 3.0526 | −1.1363 | 0.4347 |
| 3.2316 | −1.2072 | 0.4347 |
| 3.3944 | −1.2737 | 0.4347 |
| 3.5410 | −1.3354 | 0.4347 |
| 3.6716 | −1.3919 | 0.4347 |
| 3.7864 | −1.4430 | 0.4347 |
| 3.8853 | −1.4884 | 0.4347 |
| 3.9687 | −1.5276 | 0.4347 |
| 4.0396 | −1.5617 | 0.4347 |
| 4.0990 | −1.5908 | 0.4347 |
| 4.1478 | −1.6150 | 0.4347 |
| 4.1867 | −1.6344 | 0.4347 |
| 4.2183 | −1.6455 | 0.4347 |
| 4.2437 | −1.6430 | 0.4347 |
| 4.2628 | −1.6337 | 0.4347 |
| 4.2752 | −1.6220 | 0.4347 |
| 4.2824 | −1.6114 | 0.4347 |
| 4.2874 | −1.5992 | 0.4347 |
| 4.2902 | −1.5819 | 0.4347 |
| 4.2870 | −1.5603 | 0.4347 |
| 4.2742 | −1.5376 | 0.4347 |
| 4.2458 | −1.5173 | 0.4347 |
| 4.2062 | −1.4948 | 0.4347 |
| 4.1568 | −1.4666 | 0.4347 |
| 4.0968 | −1.4323 | 0.4347 |
| 4.0255 | −1.3913 | 0.4347 |
| 3.9422 | −1.3430 | 0.4347 |
| 3.8441 | −1.2855 | 0.4347 |
| 3.7310 | −1.2187 | 0.4347 |
| 3.6031 | −1.1428 | 0.4347 |
| 3.4601 | −1.0580 | 0.4347 |
| 3.3019 | −0.9644 | 0.4347 |
| 3.1284 | −0.8623 | 0.4347 |
| 2.9469 | −0.7567 | 0.4347 |
| 2.7574 | −0.6479 | 0.4347 |
| 2.5594 | −0.5366 | 0.4347 |
| 2.3530 | −0.4232 | 0.4347 |
| 2.1378 | −0.3083 | 0.4347 |
| 1.9135 | −0.1926 | 0.4347 |
| 1.6799 | −0.0768 | 0.4347 |
| 1.4444 | 0.0347 | 0.4347 |
| 1.2070 | 0.1415 | 0.4347 |
| 0.9675 | 0.2432 | 0.4347 |
| 0.7258 | 0.3398 | 0.4347 |
| 0.4818 | 0.4308 | 0.4347 |
| 0.2353 | 0.5159 | 0.4347 |
| −0.0138 | 0.5945 | 0.4347 |
| −0.2659 | 0.6662 | 0.4347 |
| −0.5210 | 0.7306 | 0.4347 |
| −0.7793 | 0.7873 | 0.4347 |
| −1.0403 | 0.8353 | 0.4347 |
| −1.2938 | 0.8722 | 0.4347 |
| −1.5398 | 0.8979 | 0.4347 |
| −1.7781 | 0.9131 | 0.4347 |
| −2.0078 | 0.9185 | 0.4347 |
| −2.2280 | 0.9146 | 0.4347 |
| −2.4386 | 0.9025 | 0.4347 |
| −2.6397 | 0.8827 | 0.4347 |
| −2.8313 | 0.8555 | 0.4347 |
| −3.0049 | 0.8234 | 0.4347 |
| −3.1604 | 0.7878 | 0.4347 |
| −3.2972 | 0.7497 | 0.4347 |
| −3.4236 | 0.7078 | 0.4347 |
| −3.5309 | 0.6651 | 0.4347 |
| −3.6107 | 0.6264 | 0.4347 |
| −3.6695 | 0.5867 | 0.4347 |
| −3.7068 | 0.5485 | 0.4347 |
| −3.7267 | 0.5139 | 0.4347 |
| −3.7325 | 0.4924 | 0.4347 |
| −3.7334 | 0.4781 | 0.4347 |
| −3.7329 | 0.4709 | 0.4347 |
| −3.7324 | 0.4674 | 0.4347 |
| −3.6150 | 0.4101 | 1.9347 |
| −3.6146 | 0.4085 | 1.9347 |
| −3.6139 | 0.4052 | 1.9347 |

TABLE A-continued

| X | Y | Z |
|---|---|---|
| −3.6119 | 0.3990 | 1.9347 |
| −3.6065 | 0.3870 | 1.9347 |
| −3.5946 | 0.3703 | 1.9347 |
| −3.5665 | 0.3464 | 1.9347 |
| −3.5226 | 0.3246 | 1.9347 |
| −3.4600 | 0.3075 | 1.9347 |
| −3.3797 | 0.2955 | 1.9347 |
| −3.2745 | 0.2838 | 1.9347 |
| −3.1530 | 0.2717 | 1.9347 |
| −3.0234 | 0.2595 | 1.9347 |
| −2.8775 | 0.2458 | 1.9347 |
| −2.7155 | 0.2298 | 1.9347 |
| −2.5375 | 0.2109 | 1.9347 |
| −2.3516 | 0.1895 | 1.9347 |
| −2.1580 | 0.1654 | 1.9347 |
| −1.9566 | 0.1384 | 1.9347 |
| −1.7475 | 0.1083 | 1.9347 |
| −1.5307 | 0.0751 | 1.9347 |
| −1.3061 | 0.0389 | 1.9347 |
| −1.0739 | −0.0009 | 1.9347 |
| −0.8342 | −0.0448 | 1.9347 |
| −0.5950 | −0.0920 | 1.9347 |
| −0.3564 | −0.1424 | 1.9347 |
| −0.1182 | −0.1959 | 1.9347 |
| 0.1194 | −0.2521 | 1.9347 |
| 0.3564 | −0.3109 | 1.9347 |
| 0.5926 | −0.3721 | 1.9347 |
| 0.8282 | −0.4357 | 1.9347 |
| 1.0631 | −0.5016 | 1.9347 |
| 1.2974 | −0.5698 | 1.9347 |
| 1.5310 | −0.6402 | 1.9347 |
| 1.7639 | −0.7131 | 1.9347 |
| 1.9884 | −0.7858 | 1.9347 |
| 2.2045 | −0.8584 | 1.9347 |
| 2.4121 | −0.9305 | 1.9347 |
| 2.6112 | −1.0020 | 1.9347 |
| 2.8020 | −1.0727 | 1.9347 |
| 2.9845 | −1.1423 | 1.9347 |
| 3.1588 | −1.2109 | 1.9347 |
| 3.3173 | −1.2750 | 1.9347 |
| 3.4601 | −1.3344 | 1.9347 |
| 3.5874 | −1.3888 | 1.9347 |
| 3.6992 | −1.4378 | 1.9347 |
| 3.7957 | −1.4814 | 1.9347 |
| 3.8769 | −1.5190 | 1.9347 |
| 3.9461 | −1.5517 | 1.9347 |
| 4.0041 | −1.5796 | 1.9347 |
| 4.0517 | −1.6027 | 1.9347 |
| 4.0897 | −1.6214 | 1.9347 |
| 4.1203 | −1.6314 | 1.9347 |
| 4.1443 | −1.6286 | 1.9347 |
| 4.1622 | −1.6193 | 1.9347 |
| 4.1738 | −1.6082 | 1.9347 |
| 4.1805 | −1.5980 | 1.9347 |
| 4.1852 | −1.5861 | 1.9347 |
| 4.1876 | −1.5693 | 1.9347 |
| 4.1842 | −1.5484 | 1.9347 |
| 4.1713 | −1.5266 | 1.9347 |
| 4.1435 | −1.5074 | 1.9347 |
| 4.1049 | −1.4860 | 1.9347 |
| 4.0566 | −1.4592 | 1.9347 |
| 3.9981 | −1.4265 | 1.9347 |
| 3.9285 | −1.3875 | 1.9347 |
| 3.8472 | −1.3415 | 1.9347 |
| 3.7514 | −1.2867 | 1.9347 |
| 3.6411 | −1.2231 | 1.9347 |
| 3.5163 | −1.1508 | 1.9347 |
| 3.3767 | −1.0699 | 1.9347 |
| 3.2224 | −0.9808 | 1.9347 |
| 3.0530 | −0.8837 | 1.9347 |
| 2.8758 | −0.7832 | 1.9347 |
| 2.6908 | −0.6798 | 1.9347 |
| 2.4976 | −0.5738 | 1.9347 |
| 2.2962 | −0.4658 | 1.9347 |
| 2.0863 | −0.3562 | 1.9347 |
| 1.8677 | −0.2456 | 1.9347 |
| 1.6402 | −0.1347 | 1.9347 |
| 1.4110 | −0.0275 | 1.9347 |

TABLE A-continued

| X | Y | Z |
|---|---|---|
| 1.1800 | 0.0754 | 1.9347 |
| 0.9472 | 0.1737 | 1.9347 |
| 0.7123 | 0.2671 | 1.9347 |
| 0.4751 | 0.3552 | 1.9347 |
| 0.2356 | 0.4376 | 1.9347 |
| −0.0065 | 0.5139 | 1.9347 |
| −0.2513 | 0.5837 | 1.9347 |
| −0.4990 | 0.6465 | 1.9347 |
| −0.7497 | 0.7020 | 1.9347 |
| −1.0023 | 0.7492 | 1.9347 |
| −1.2478 | 0.7858 | 1.9347 |
| −1.4860 | 0.8120 | 1.9347 |
| −1.7169 | 0.8282 | 1.9347 |
| −1.9393 | 0.8350 | 1.9347 |
| −2.1524 | 0.8330 | 1.9347 |
| −2.3565 | 0.8229 | 1.9347 |
| −2.5515 | 0.8053 | 1.9347 |
| −2.7375 | 0.7806 | 1.9347 |
| −2.9061 | 0.7509 | 1.9347 |
| −3.0572 | 0.7175 | 1.9347 |
| −3.1901 | 0.6815 | 1.9347 |
| −3.3130 | 0.6420 | 1.9347 |
| −3.4171 | 0.6012 | 1.9347 |
| −3.4945 | 0.5638 | 1.9347 |
| −3.5517 | 0.5260 | 1.9347 |
| −3.5886 | 0.4897 | 1.9347 |
| −3.6088 | 0.4567 | 1.9347 |
| −3.6150 | 0.4360 | 1.9347 |
| −3.6162 | 0.4222 | 1.9347 |
| −3.6158 | 0.4153 | 1.9347 |
| −3.6153 | 0.4118 | 1.9347 |
| −3.5579 | 0.3838 | 2.6847 |
| −3.5576 | 0.3822 | 2.6847 |
| −3.5569 | 0.3791 | 2.6847 |
| −3.5550 | 0.3729 | 2.6847 |
| −3.5496 | 0.3611 | 2.6847 |
| −3.5378 | 0.3447 | 2.6847 |
| −3.5099 | 0.3214 | 2.6847 |
| −3.4663 | 0.3005 | 2.6847 |
| −3.4046 | 0.2842 | 2.6847 |
| −3.3253 | 0.2731 | 2.6847 |
| −3.2216 | 0.2620 | 2.6847 |
| −3.1018 | 0.2504 | 2.6847 |
| −2.9740 | 0.2389 | 2.6847 |
| −2.8302 | 0.2258 | 2.6847 |
| −2.6706 | 0.2103 | 2.6847 |
| −2.4951 | 0.1919 | 2.6847 |
| −2.3120 | 0.1709 | 2.6847 |
| −2.1212 | 0.1472 | 2.6847 |
| −1.9228 | 0.1205 | 2.6847 |
| −1.7167 | 0.0907 | 2.6847 |
| −1.5030 | 0.0580 | 2.6847 |
| −1.2817 | 0.0222 | 2.6847 |
| −1.0529 | −0.0170 | 2.6847 |
| −0.8166 | −0.0603 | 2.6847 |
| −0.5808 | −0.1068 | 2.6847 |
| −0.3456 | −0.1566 | 2.6847 |
| −0.1108 | −0.2094 | 2.6847 |
| 0.1233 | −0.2648 | 2.6847 |
| 0.3567 | −0.3228 | 2.6847 |
| 0.5894 | −0.3832 | 2.6847 |
| 0.8214 | −0.4460 | 2.6847 |
| 1.0529 | −0.5109 | 2.6847 |
| 1.2838 | −0.5779 | 2.6847 |
| 1.5140 | −0.6471 | 2.6847 |
| 1.7437 | −0.7185 | 2.6847 |
| 1.9651 | −0.7898 | 2.6847 |
| 2.1781 | −0.8608 | 2.6847 |
| 2.3828 | −0.9314 | 2.6847 |
| 2.5793 | −1.0012 | 2.6847 |
| 2.7674 | −1.0703 | 2.6847 |
| 2.9475 | −1.1384 | 2.6847 |
| 3.1194 | −1.2055 | 2.6847 |
| 3.2757 | −1.2682 | 2.6847 |
| 3.4166 | −1.3262 | 2.6847 |
| 3.5422 | −1.3794 | 2.6847 |
| 3.6525 | −1.4274 | 2.6847 |
| 3.7478 | −1.4699 | 2.6847 |

TABLE A-continued

| X | Y | Z |
|---|---|---|
| 3.8280 | −1.5067 | 2.6847 |
| 3.8963 | −1.5386 | 2.6847 |
| 3.9535 | −1.5658 | 2.6847 |
| 4.0005 | −1.5884 | 2.6847 |
| 4.0380 | −1.6066 | 2.6847 |
| 4.0682 | −1.6169 | 2.6847 |
| 4.0920 | −1.6143 | 2.6847 |
| 4.1099 | −1.6052 | 2.6847 |
| 4.1215 | −1.5941 | 2.6847 |
| 4.1281 | −1.5839 | 2.6847 |
| 4.1327 | −1.5722 | 2.6847 |
| 4.1349 | −1.5557 | 2.6847 |
| 4.1313 | −1.5351 | 2.6847 |
| 4.1184 | −1.5138 | 2.6847 |
| 4.0907 | −1.4952 | 2.6847 |
| 4.0526 | −1.4743 | 2.6847 |
| 4.0050 | −1.4482 | 2.6847 |
| 3.9471 | −1.4164 | 2.6847 |
| 3.8784 | −1.3783 | 2.6847 |
| 3.7981 | −1.3335 | 2.6847 |
| 3.7035 | −1.2802 | 2.6847 |
| 3.5945 | −1.2183 | 2.6847 |
| 3.4712 | −1.1478 | 2.6847 |
| 3.3333 | −1.0691 | 2.6847 |
| 3.1808 | −0.9823 | 2.6847 |
| 3.0135 | −0.8877 | 2.6847 |
| 2.8385 | −0.7898 | 2.6847 |
| 2.6557 | −0.6890 | 2.6847 |
| 2.4650 | −0.5857 | 2.6847 |
| 2.2661 | −0.4804 | 2.6847 |
| 2.0589 | −0.3735 | 2.6847 |
| 1.8431 | −0.2657 | 2.6847 |
| 1.6185 | −0.1575 | 2.6847 |
| 1.3922 | −0.0530 | 2.6847 |
| 1.1643 | 0.0473 | 2.6847 |
| 0.9345 | 0.1432 | 2.6847 |
| 0.7027 | 0.2343 | 2.6847 |
| 0.4688 | 0.3204 | 2.6847 |
| 0.2326 | 0.4010 | 2.6847 |
| −0.0060 | 0.4757 | 2.6847 |
| −0.2473 | 0.5442 | 2.6847 |
| −0.4913 | 0.6061 | 2.6847 |
| −0.7381 | 0.6609 | 2.6847 |
| −0.9864 | 0.7075 | 2.6847 |
| −1.2277 | 0.7440 | 2.6847 |
| −1.4620 | 0.7703 | 2.6847 |
| −1.6890 | 0.7870 | 2.6847 |
| −1.9075 | 0.7944 | 2.6847 |
| −2.1170 | 0.7932 | 2.6847 |
| −2.3177 | 0.7840 | 2.6847 |
| −2.5095 | 0.7675 | 2.6847 |
| −2.6925 | 0.7439 | 2.6847 |
| −2.8585 | 0.7153 | 2.6847 |
| −3.0073 | 0.6831 | 2.6847 |
| −3.1381 | 0.6483 | 2.6847 |
| −3.2591 | 0.6098 | 2.6847 |
| −3.3618 | 0.5702 | 2.6847 |
| −3.4382 | 0.5339 | 2.6847 |
| −3.4948 | 0.4972 | 2.6847 |
| −3.5314 | 0.4618 | 2.6847 |
| −3.5516 | 0.4296 | 2.6847 |
| −3.5579 | 0.4093 | 2.6847 |
| −3.5591 | 0.3957 | 2.6847 |
| −3.5587 | 0.3889 | 2.6847 |
| −3.5582 | 0.3855 | 2.6847 |
| −3.5018 | 0.3577 | 3.4347 |
| −3.5015 | 0.3561 | 3.4347 |
| −3.5008 | 0.3530 | 3.4347 |
| −3.4989 | 0.3469 | 3.4347 |
| −3.4936 | 0.3353 | 3.4347 |
| −3.4818 | 0.3192 | 3.4347 |
| −3.4541 | 0.2967 | 3.4347 |
| −3.4110 | 0.2765 | 3.4347 |
| −3.3500 | 0.2611 | 3.4347 |
| −3.2718 | 0.2507 | 3.4347 |
| −3.1697 | 0.2402 | 3.4347 |
| −3.0516 | 0.2292 | 3.4347 |
| −2.9257 | 0.2183 | 3.4347 |

TABLE A-continued

| X | Y | Z |
|---|---|---|
| −2.7840 | 0.2058 | 3.4347 |
| −2.6267 | 0.1908 | 3.4347 |
| −2.4539 | 0.1730 | 3.4347 |
| −2.2735 | 0.1526 | 3.4347 |
| −2.0856 | 0.1295 | 3.4347 |
| −1.8901 | 0.1034 | 3.4347 |
| −1.6871 | 0.0743 | 3.4347 |
| −1.4765 | 0.0423 | 3.4347 |
| −1.2585 | 0.0073 | 3.4347 |
| −1.0330 | −0.0312 | 3.4347 |
| −0.8002 | −0.0737 | 3.4347 |
| −0.5678 | −0.1193 | 3.4347 |
| −0.3359 | −0.1681 | 3.4347 |
| −0.1047 | −0.2199 | 3.4347 |
| 0.1259 | −0.2743 | 3.4347 |
| 0.3558 | −0.3311 | 3.4347 |
| 0.5850 | −0.3904 | 3.4347 |
| 0.8136 | −0.4520 | 3.4347 |
| 1.0416 | −0.5156 | 3.4347 |
| 1.2691 | −0.5812 | 3.4347 |
| 1.4960 | −0.6489 | 3.4347 |
| 1.7224 | −0.7186 | 3.4347 |
| 1.9407 | −0.7880 | 3.4347 |
| 2.1508 | −0.8571 | 3.4347 |
| 2.3527 | −0.9258 | 3.4347 |
| 2.5464 | −0.9937 | 3.4347 |
| 2.7320 | −1.0609 | 3.4347 |
| 2.9096 | −1.1272 | 3.4347 |
| 3.0792 | −1.1924 | 3.4347 |
| 3.2335 | −1.2535 | 3.4347 |
| 3.3725 | −1.3100 | 3.4347 |
| 3.4965 | −1.3618 | 3.4347 |
| 3.6053 | −1.4085 | 3.4347 |
| 3.6993 | −1.4499 | 3.4347 |
| 3.7785 | −1.4858 | 3.4347 |
| 3.8459 | −1.5169 | 3.4347 |
| 3.9024 | −1.5434 | 3.4347 |
| 3.9488 | −1.5654 | 3.4347 |
| 3.9859 | −1.5831 | 3.4347 |
| 4.0156 | −1.5934 | 3.4347 |
| 4.0392 | −1.5909 | 3.4347 |
| 4.0568 | −1.5820 | 3.4347 |
| 4.0682 | −1.5710 | 3.4347 |
| 4.0747 | −1.5609 | 3.4347 |
| 4.0791 | −1.5493 | 3.4347 |
| 4.0812 | −1.5330 | 3.4347 |
| 4.0774 | −1.5128 | 3.4347 |
| 4.0644 | −1.4920 | 3.4347 |
| 4.0370 | −1.4740 | 3.4347 |
| 3.9993 | −1.4537 | 3.4347 |
| 3.9523 | −1.4283 | 3.4347 |
| 3.8952 | −1.3974 | 3.4347 |
| 3.8273 | −1.3605 | 3.4347 |
| 3.7480 | −1.3170 | 3.4347 |
| 3.6546 | −1.2652 | 3.4347 |
| 3.5469 | −1.2050 | 3.4347 |
| 3.4250 | −1.1367 | 3.4347 |
| 3.2888 | −1.0602 | 3.4347 |
| 3.1381 | −0.9760 | 3.4347 |
| 2.9728 | −0.8842 | 3.4347 |
| 2.7999 | −0.7892 | 3.4347 |
| 2.6194 | −0.6914 | 3.4347 |
| 2.4310 | −0.5911 | 3.4347 |
| 2.2346 | −0.4889 | 3.4347 |
| 2.0299 | −0.3852 | 3.4347 |
| 1.8168 | −0.2806 | 3.4347 |
| 1.5950 | −0.1756 | 3.4347 |
| 1.3717 | −0.0743 | 3.4347 |
| 1.1467 | 0.0231 | 3.4347 |
| 0.9199 | 0.1161 | 3.4347 |
| 0.6912 | 0.2046 | 3.4347 |
| 0.4605 | 0.2883 | 3.4347 |
| 0.2277 | 0.3668 | 3.4347 |
| −0.0075 | 0.4397 | 3.4347 |
| −0.2452 | 0.5065 | 3.4347 |
| −0.4855 | 0.5671 | 3.4347 |
| −0.7282 | 0.6207 | 3.4347 |
| −0.9721 | 0.6664 | 3.4347 |

TABLE A-continued

| X | Y | Z |
|---|---|---|
| −1.2093 | 0.7024 | 3.4347 |
| −1.4396 | 0.7287 | 3.4347 |
| −1.6626 | 0.7455 | 3.4347 |
| −1.8771 | 0.7534 | 3.4347 |
| −2.0830 | 0.7528 | 3.4347 |
| −2.2802 | 0.7446 | 3.4347 |
| −2.4687 | 0.7290 | 3.4347 |
| −2.6487 | 0.7066 | 3.4347 |
| −2.8120 | 0.6792 | 3.4347 |
| −2.9584 | 0.6482 | 3.4347 |
| −3.0872 | 0.6146 | 3.4347 |
| −3.2063 | 0.5774 | 3.4347 |
| −3.3074 | 0.5390 | 3.4347 |
| −3.3828 | 0.5039 | 3.4347 |
| −3.4389 | 0.4684 | 3.4347 |
| −3.4752 | 0.4341 | 3.4347 |
| −3.4953 | 0.4026 | 3.4347 |
| −3.5016 | 0.3827 | 3.4347 |
| −3.5029 | 0.3693 | 3.4347 |
| −3.5026 | 0.3627 | 3.4347 |
| −3.5021 | 0.3593 | 3.4347 |
| −3.3926 | 0.3112 | 4.9347 |
| −3.3923 | 0.3097 | 4.9347 |
| −3.3916 | 0.3067 | 4.9347 |
| −3.3897 | 0.3008 | 4.9347 |
| −3.3843 | 0.2896 | 4.9347 |
| −3.3723 | 0.2745 | 4.9347 |
| −3.3446 | 0.2538 | 4.9347 |
| −3.3022 | 0.2356 | 4.9347 |
| −3.2429 | 0.2217 | 4.9347 |
| −3.1670 | 0.2119 | 4.9347 |
| −3.0679 | 0.2024 | 4.9347 |
| −2.9534 | 0.1932 | 4.9347 |
| −2.8312 | 0.1836 | 4.9347 |
| −2.6939 | 0.1724 | 4.9347 |
| −2.5413 | 0.1589 | 4.9347 |
| −2.3738 | 0.1425 | 4.9347 |
| −2.1989 | 0.1235 | 4.9347 |
| −2.0166 | 0.1017 | 4.9347 |
| −1.8271 | 0.0770 | 4.9347 |
| −1.6303 | 0.0495 | 4.9347 |
| −1.4261 | 0.0193 | 4.9347 |
| −1.2147 | −0.0139 | 4.9347 |
| −0.9960 | −0.0503 | 4.9347 |
| −0.7701 | −0.0907 | 4.9347 |
| −0.5447 | −0.1340 | 4.9347 |
| −0.3198 | −0.1803 | 4.9347 |
| −0.0955 | −0.2294 | 4.9347 |
| 0.1281 | −0.2809 | 4.9347 |
| 0.3511 | −0.3348 | 4.9347 |
| 0.5736 | −0.3910 | 4.9347 |
| 0.7954 | −0.4493 | 4.9347 |
| 1.0168 | −0.5096 | 4.9347 |
| 1.2376 | −0.5718 | 4.9347 |
| 1.4580 | −0.6358 | 4.9347 |
| 1.6778 | −0.7019 | 4.9347 |
| 1.8898 | −0.7676 | 4.9347 |
| 2.0939 | −0.8330 | 4.9347 |
| 2.2900 | −0.8979 | 4.9347 |
| 2.4783 | −0.9622 | 4.9347 |
| 2.6588 | −1.0257 | 4.9347 |
| 2.8315 | −1.0883 | 4.9347 |
| 2.9964 | −1.1499 | 4.9347 |
| 3.1465 | −1.2076 | 4.9347 |
| 3.2817 | −1.2610 | 4.9347 |
| 3.4024 | −1.3099 | 4.9347 |
| 3.5084 | −1.3540 | 4.9347 |
| 3.5999 | −1.3930 | 4.9347 |
| 3.6770 | −1.4268 | 4.9347 |
| 3.7427 | −1.4562 | 4.9347 |
| 3.7978 | −1.4811 | 4.9347 |
| 3.8430 | −1.5019 | 4.9347 |
| 3.8792 | −1.5186 | 4.9347 |
| 3.9080 | −1.5286 | 4.9347 |
| 3.9309 | −1.5263 | 4.9347 |
| 3.9480 | −1.5176 | 4.9347 |
| 3.9590 | −1.5068 | 4.9347 |
| 3.9651 | −1.4969 | 4.9347 |

TABLE A-continued

| X | Y | Z |
|---|---|---|
| 3.9692 | −1.4856 | 4.9347 |
| 3.9708 | −1.4698 | 4.9347 |
| 3.9667 | −1.4503 | 4.9347 |
| 3.9534 | −1.4306 | 4.9347 |
| 3.9264 | −1.4138 | 4.9347 |
| 3.8897 | −1.3948 | 4.9347 |
| 3.8439 | −1.3710 | 4.9347 |
| 3.7882 | −1.3420 | 4.9347 |
| 3.7220 | −1.3074 | 4.9347 |
| 3.6446 | −1.2667 | 4.9347 |
| 3.5534 | −1.2182 | 4.9347 |
| 3.4482 | −1.1619 | 4.9347 |
| 3.3292 | −1.0980 | 4.9347 |
| 3.1962 | −1.0265 | 4.9347 |
| 3.0490 | −0.9477 | 4.9347 |
| 2.8876 | −0.8619 | 4.9347 |
| 2.7188 | −0.7731 | 4.9347 |
| 2.5424 | −0.6816 | 4.9347 |
| 2.3583 | −0.5877 | 4.9347 |
| 2.1662 | −0.4919 | 4.9347 |
| 1.9661 | −0.3948 | 4.9347 |
| 1.7580 | −0.2967 | 4.9347 |
| 1.5416 | −0.1984 | 4.9347 |
| 1.3240 | −0.1035 | 4.9347 |
| 1.1051 | −0.0124 | 4.9347 |
| 0.8848 | 0.0746 | 4.9347 |
| 0.6631 | 0.1574 | 4.9347 |
| 0.4397 | 0.2357 | 4.9347 |
| 0.2147 | 0.3092 | 4.9347 |
| −0.0121 | 0.3774 | 4.9347 |
| −0.2409 | 0.4401 | 4.9347 |
| −0.4717 | 0.4970 | 4.9347 |
| −0.7047 | 0.5476 | 4.9347 |
| −0.9400 | 0.5912 | 4.9347 |
| −1.1695 | 0.6260 | 4.9347 |
| −1.3918 | 0.6518 | 4.9347 |
| −1.6069 | 0.6689 | 4.9347 |
| −1.8149 | 0.6777 | 4.9347 |
| −2.0150 | 0.6785 | 4.9347 |
| −2.2068 | 0.6718 | 4.9347 |
| −2.3905 | 0.6580 | 4.9347 |
| −2.5654 | 0.6375 | 4.9347 |
| −2.7236 | 0.6123 | 4.9347 |
| −2.8649 | 0.5836 | 4.9347 |
| −2.9892 | 0.5525 | 4.9347 |
| −3.1043 | 0.5178 | 4.9347 |
| −3.2021 | 0.4820 | 4.9347 |
| −3.2753 | 0.4494 | 4.9347 |
| −3.3299 | 0.4165 | 4.9347 |
| −3.3656 | 0.3843 | 4.9347 |
| −3.3857 | 0.3543 | 4.9347 |
| −3.3921 | 0.3353 | 4.9347 |
| −3.3935 | 0.3225 | 4.9347 |
| −3.3933 | 0.3161 | 4.9347 |
| −3.3928 | 0.3128 | 4.9347 |
| −3.2902 | 0.2695 | 6.4347 |
| −3.2899 | 0.2680 | 6.4347 |
| −3.2892 | 0.2650 | 6.4347 |
| −3.2873 | 0.2594 | 6.4347 |
| −3.2819 | 0.2487 | 6.4347 |
| −3.2700 | 0.2344 | 6.4347 |
| −3.2427 | 0.2151 | 6.4347 |
| −3.2013 | 0.1986 | 6.4347 |
| −3.1436 | 0.1864 | 6.4347 |
| −3.0701 | 0.1779 | 6.4347 |
| −2.9741 | 0.1697 | 6.4347 |
| −2.8633 | 0.1619 | 6.4347 |
| −2.7450 | 0.1538 | 6.4347 |
| −2.6120 | 0.1440 | 6.4347 |
| −2.4644 | 0.1319 | 6.4347 |
| −2.3021 | 0.1172 | 6.4347 |
| −2.1327 | 0.1000 | 6.4347 |
| −1.9560 | 0.0801 | 6.4347 |
| −1.7722 | 0.0573 | 6.4347 |
| −1.5813 | 0.0319 | 6.4347 |
| −1.3834 | 0.0039 | 6.4347 |
| −1.1784 | −0.0269 | 6.4347 |
| −0.9665 | −0.0609 | 6.4347 |

TABLE A-continued

| X | Y | Z |
|---|---|---|
| −0.7477 | −0.0984 | 6.4347 |
| −0.5293 | −0.1388 | 6.4347 |
| −0.3115 | −0.1820 | 6.4347 |
| −0.0941 | −0.2278 | 6.4347 |
| 0.1229 | −0.2759 | 6.4347 |
| 0.3394 | −0.3263 | 6.4347 |
| 0.5553 | −0.3788 | 6.4347 |
| 0.7707 | −0.4333 | 6.4347 |
| 0.9856 | −0.4896 | 6.4347 |
| 1.2000 | −0.5477 | 6.4347 |
| 1.4139 | −0.6076 | 6.4347 |
| 1.6273 | −0.6692 | 6.4347 |
| 1.8332 | −0.7307 | 6.4347 |
| 2.0314 | −0.7917 | 6.4347 |
| 2.2221 | −0.8523 | 6.4347 |
| 2.4051 | −0.9123 | 6.4347 |
| 2.5806 | −0.9715 | 6.4347 |
| 2.7486 | −1.0299 | 6.4347 |
| 2.9090 | −1.0874 | 6.4347 |
| 3.0551 | −1.1411 | 6.4347 |
| 3.1868 | −1.1908 | 6.4347 |
| 3.3042 | −1.2363 | 6.4347 |
| 3.4075 | −1.2774 | 6.4347 |
| 3.4967 | −1.3138 | 6.4347 |
| 3.5719 | −1.3452 | 6.4347 |
| 3.6360 | −1.3725 | 6.4347 |
| 3.6897 | −1.3958 | 6.4347 |
| 3.7339 | −1.4151 | 6.4347 |
| 3.7691 | −1.4306 | 6.4347 |
| 3.7970 | −1.4397 | 6.4347 |
| 3.8188 | −1.4372 | 6.4347 |
| 3.8350 | −1.4286 | 6.4347 |
| 3.8452 | −1.4181 | 6.4347 |
| 3.8509 | −1.4086 | 6.4347 |
| 3.8546 | −1.3976 | 6.4347 |
| 3.8558 | −1.3823 | 6.4347 |
| 3.8512 | −1.3636 | 6.4347 |
| 3.8377 | −1.3450 | 6.4347 |
| 3.8112 | −1.3297 | 6.4347 |
| 3.7754 | −1.3121 | 6.4347 |
| 3.7307 | −1.2900 | 6.4347 |
| 3.6764 | −1.2632 | 6.4347 |
| 3.6118 | −1.2312 | 6.4347 |
| 3.5364 | −1.1935 | 6.4347 |
| 3.4473 | −1.1486 | 6.4347 |
| 3.3447 | −1.0966 | 6.4347 |
| 3.2285 | −1.0374 | 6.4347 |
| 3.0987 | −0.9713 | 6.4347 |
| 2.9550 | −0.8985 | 6.4347 |
| 2.7975 | −0.8192 | 6.4347 |
| 2.6327 | −0.7371 | 6.4347 |
| 2.4607 | −0.6526 | 6.4347 |
| 2.2811 | −0.5659 | 6.4347 |
| 2.0939 | −0.4774 | 6.4347 |
| 1.8991 | −0.3876 | 6.4347 |
| 1.6964 | −0.2971 | 6.4347 |
| 1.4859 | −0.2062 | 6.4347 |
| 1.2742 | −0.1185 | 6.4347 |
| 1.0614 | −0.0341 | 6.4347 |
| 0.8473 | 0.0466 | 6.4347 |
| 0.6318 | 0.1234 | 6.4347 |
| 0.4150 | 0.1960 | 6.4347 |
| 0.1966 | 0.2643 | 6.4347 |
| −0.0235 | 0.3277 | 6.4347 |
| −0.2452 | 0.3861 | 6.4347 |
| −0.4689 | 0.4392 | 6.4347 |
| −0.6945 | 0.4864 | 6.4347 |
| −0.9221 | 0.5273 | 6.4347 |
| −1.1431 | 0.5598 | 6.4347 |
| −1.3573 | 0.5842 | 6.4347 |
| −1.5647 | 0.6006 | 6.4347 |
| −1.7651 | 0.6093 | 6.4347 |
| −1.9577 | 0.6106 | 6.4347 |
| −2.1427 | 0.6048 | 6.4347 |
| −2.3197 | 0.5924 | 6.4347 |
| −2.4883 | 0.5738 | 6.4347 |
| −2.6409 | 0.5506 | 6.4347 |
| −2.7772 | 0.5242 | 6.4347 |

TABLE A-continued

| X | Y | Z |
|---|---|---|
| −2.8973 | 0.4955 | 6.4347 |
| −3.0085 | 0.4633 | 6.4347 |
| −3.1031 | 0.4300 | 6.4347 |
| −3.1742 | 0.3998 | 6.4347 |
| −3.2276 | 0.3694 | 6.4347 |
| −3.2628 | 0.3392 | 6.4347 |
| −3.2828 | 0.3109 | 6.4347 |
| −3.2894 | 0.2927 | 6.4347 |
| −3.2910 | 0.2804 | 6.4347 |
| −3.2908 | 0.2741 | 6.4347 |
| −3.2904 | 0.2710 | 6.4347 |
| −3.1908 | 0.2283 | 7.9347 |
| −3.1906 | 0.2269 | 7.9347 |
| −3.1899 | 0.2241 | 7.9347 |
| −3.1881 | 0.2186 | 7.9347 |
| −3.1827 | 0.2083 | 7.9347 |
| −3.1710 | 0.1947 | 7.9347 |
| −3.1441 | 0.1766 | 7.9347 |
| −3.1038 | 0.1617 | 7.9347 |
| −3.0477 | 0.1512 | 7.9347 |
| −2.9764 | 0.1442 | 7.9347 |
| −2.8836 | 0.1374 | 7.9347 |
| −2.7764 | 0.1309 | 7.9347 |
| −2.6620 | 0.1241 | 7.9347 |
| −2.5334 | 0.1158 | 7.9347 |
| −2.3906 | 0.1053 | 7.9347 |
| −2.2337 | 0.0924 | 7.9347 |
| −2.0699 | 0.0772 | 7.9347 |
| −1.8992 | 0.0594 | 7.9347 |
| −1.7215 | 0.0389 | 7.9347 |
| −1.5370 | 0.0160 | 7.9347 |
| −1.3455 | −0.0094 | 7.9347 |
| −1.1472 | −0.0374 | 7.9347 |
| −0.9420 | −0.0684 | 7.9347 |
| −0.7300 | −0.1028 | 7.9347 |
| −0.5186 | −0.1399 | 7.9347 |
| −0.3077 | −0.1796 | 7.9347 |
| −0.0974 | −0.2217 | 7.9347 |
| 0.1125 | −0.2660 | 7.9347 |
| 0.3220 | −0.3123 | 7.9347 |
| 0.5311 | −0.3607 | 7.9347 |
| 0.7398 | −0.4109 | 7.9347 |
| 0.9481 | −0.4629 | 7.9347 |
| 1.1559 | −0.5165 | 7.9347 |
| 1.3633 | −0.5717 | 7.9347 |
| 1.5703 | −0.6285 | 7.9347 |
| 1.7699 | −0.6851 | 7.9347 |
| 1.9621 | −0.7413 | 7.9347 |
| 2.1471 | −0.7971 | 7.9347 |
| 2.3248 | −0.8524 | 7.9347 |
| 2.4952 | −0.9070 | 7.9347 |
| 2.6583 | −0.9607 | 7.9347 |
| 2.8142 | −1.0136 | 7.9347 |
| 2.9561 | −1.0630 | 7.9347 |
| 3.0842 | −1.1088 | 7.9347 |
| 3.1984 | −1.1506 | 7.9347 |
| 3.2989 | −1.1884 | 7.9347 |
| 3.3857 | −1.2219 | 7.9347 |
| 3.4590 | −1.2508 | 7.9347 |
| 3.5214 | −1.2759 | 7.9347 |
| 3.5738 | −1.2972 | 7.9347 |
| 3.6168 | −1.3149 | 7.9347 |
| 3.6511 | −1.3292 | 7.9347 |
| 3.6782 | −1.3381 | 7.9347 |
| 3.6996 | −1.3359 | 7.9347 |
| 3.7154 | −1.3274 | 7.9347 |
| 3.7253 | −1.3170 | 7.9347 |
| 3.7307 | −1.3076 | 7.9347 |
| 3.7340 | −1.2969 | 7.9347 |
| 3.7347 | −1.2821 | 7.9347 |
| 3.7297 | −1.2643 | 7.9347 |
| 3.7160 | −1.2469 | 7.9347 |
| 3.6900 | −1.2329 | 7.9347 |
| 3.6551 | −1.2168 | 7.9347 |
| 3.6115 | −1.1966 | 7.9347 |
| 3.5586 | −1.1720 | 7.9347 |
| 3.4957 | −1.1427 | 7.9347 |
| 3.4221 | −1.1081 | 7.9347 |

TABLE A-continued

| X | Y | Z |
|---|---|---|
| 3.3353 | −1.0671 | 7.9347 |
| 3.2353 | −1.0194 | 7.9347 |
| 3.1220 | −0.9652 | 7.9347 |
| 2.9953 | −0.9047 | 7.9347 |
| 2.8553 | −0.8380 | 7.9347 |
| 2.7017 | −0.7654 | 7.9347 |
| 2.5411 | −0.6902 | 7.9347 |
| 2.3734 | −0.6128 | 7.9347 |
| 2.1985 | −0.5334 | 7.9347 |
| 2.0163 | −0.4525 | 7.9347 |
| 1.8267 | −0.3703 | 7.9347 |
| 1.6296 | −0.2874 | 7.9347 |
| 1.4249 | −0.2041 | 7.9347 |
| 1.2192 | −0.1237 | 7.9347 |
| 1.0125 | −0.0464 | 7.9347 |
| 0.8046 | 0.0277 | 7.9347 |
| 0.5956 | 0.0982 | 7.9347 |
| 0.3852 | 0.1650 | 7.9347 |
| 0.1735 | 0.2277 | 7.9347 |
| −0.0397 | 0.2861 | 7.9347 |
| −0.2544 | 0.3398 | 7.9347 |
| −0.4709 | 0.3886 | 7.9347 |
| −0.6890 | 0.4321 | 7.9347 |
| −0.9081 | 0.4696 | 7.9347 |
| −1.1209 | 0.4994 | 7.9347 |
| −1.3271 | 0.5219 | 7.9347 |
| −1.5268 | 0.5371 | 7.9347 |
| −1.7194 | 0.5452 | 7.9347 |
| −1.9047 | 0.5464 | 7.9347 |
| −2.0827 | 0.5411 | 7.9347 |
| −2.2530 | 0.5297 | 7.9347 |
| −2.4153 | 0.5125 | 7.9347 |
| −2.5622 | 0.4911 | 7.9347 |
| −2.6935 | 0.4665 | 7.9347 |
| −2.8093 | 0.4400 | 7.9347 |
| −2.9165 | 0.4100 | 7.9347 |
| −3.0079 | 0.3790 | 7.9347 |
| −3.0767 | 0.3511 | 7.9347 |
| −3.1287 | 0.3229 | 7.9347 |
| −3.1633 | 0.2947 | 7.9347 |
| −3.1832 | 0.2679 | 7.9347 |
| −3.1899 | 0.2506 | 7.9347 |
| −3.1916 | 0.2387 | 7.9347 |
| −3.1914 | 0.2328 | 7.9347 |
| −3.1911 | 0.2298 | 7.9347 |
| −3.0924 | 0.1898 | 9.4347 |
| −3.0921 | 0.1884 | 9.4347 |
| −3.0915 | 0.1857 | 9.4347 |
| −3.0897 | 0.1805 | 9.4347 |
| −3.0843 | 0.1706 | 9.4347 |
| −3.0727 | 0.1578 | 9.4347 |
| −3.0463 | 0.1411 | 9.4347 |
| −3.0071 | 0.1279 | 9.4347 |
| −2.9527 | 0.1190 | 9.4347 |
| −2.8839 | 0.1133 | 9.4347 |
| −2.7942 | 0.1079 | 9.4347 |
| −2.6907 | 0.1028 | 9.4347 |
| −2.5803 | 0.0975 | 9.4347 |
| −2.4562 | 0.0908 | 9.4347 |
| −2.3184 | 0.0820 | 9.4347 |
| −2.1670 | 0.0711 | 9.4347 |
| −2.0088 | 0.0579 | 9.4347 |
| −1.8440 | 0.0422 | 9.4347 |
| −1.6724 | 0.0241 | 9.4347 |
| −1.4942 | 0.0037 | 9.4347 |
| −1.3092 | −0.0190 | 9.4347 |
| −1.1176 | −0.0441 | 9.4347 |
| −0.9193 | −0.0719 | 9.4347 |
| −0.7146 | −0.1029 | 9.4347 |
| −0.5103 | −0.1362 | 9.4347 |
| −0.3064 | −0.1721 | 9.4347 |
| −0.1029 | −0.2101 | 9.4347 |
| 0.1002 | −0.2501 | 9.4347 |
| 0.3029 | −0.2920 | 9.4347 |
| 0.5054 | −0.3357 | 9.4347 |
| 0.7074 | −0.3811 | 9.4347 |
| 0.9091 | −0.4280 | 9.4347 |
| 1.1104 | −0.4764 | 9.4347 |

TABLE A-continued

| X | Y | Z |
|---|---|---|
| 1.3113 | −0.5263 | 9.4347 |
| 1.5118 | −0.5776 | 9.4347 |
| 1.7053 | −0.6287 | 9.4347 |
| 1.8918 | −0.6796 | 9.4347 |
| 2.0713 | −0.7300 | 9.4347 |
| 2.2437 | −0.7799 | 9.4347 |
| 2.4090 | −0.8293 | 9.4347 |
| 2.5674 | −0.8779 | 9.4347 |
| 2.7188 | −0.9257 | 9.4347 |
| 2.8567 | −0.9704 | 9.4347 |
| 2.9812 | −1.0118 | 9.4347 |
| 3.0923 | −1.0498 | 9.4347 |
| 3.1900 | −1.0840 | 9.4347 |
| 3.2745 | −1.1143 | 9.4347 |
| 3.3458 | −1.1405 | 9.4347 |
| 3.4066 | −1.1633 | 9.4347 |
| 3.4576 | −1.1826 | 9.4347 |
| 3.4995 | −1.1987 | 9.4347 |
| 3.5329 | −1.2117 | 9.4347 |
| 3.5592 | −1.2198 | 9.4347 |
| 3.5796 | −1.2173 | 9.4347 |
| 3.5946 | −1.2090 | 9.4347 |
| 3.6039 | −1.1988 | 9.4347 |
| 3.6087 | −1.1897 | 9.4347 |
| 3.6116 | −1.1793 | 9.4347 |
| 3.6119 | −1.1650 | 9.4347 |
| 3.6064 | −1.1481 | 9.4347 |
| 3.5925 | −1.1319 | 9.4347 |
| 3.5670 | −1.1194 | 9.4347 |
| 3.5331 | −1.1048 | 9.4347 |
| 3.4906 | −1.0865 | 9.4347 |
| 3.4391 | −1.0642 | 9.4347 |
| 3.3778 | −1.0377 | 9.4347 |
| 3.3062 | −1.0064 | 9.4347 |
| 3.2216 | −0.9693 | 9.4347 |
| 3.1241 | −0.9261 | 9.4347 |
| 3.0136 | −0.8772 | 9.4347 |
| 2.8902 | −0.8224 | 9.4347 |
| 2.7537 | −0.7622 | 9.4347 |
| 2.6040 | −0.6966 | 9.4347 |
| 2.4475 | −0.6287 | 9.4347 |
| 2.2841 | −0.5588 | 9.4347 |
| 2.1138 | −0.4872 | 9.4347 |
| 1.9364 | −0.4142 | 9.4347 |
| 1.7519 | −0.3401 | 9.4347 |
| 1.5600 | −0.2653 | 9.4347 |
| 1.3607 | −0.1901 | 9.4347 |
| 1.1605 | −0.1175 | 9.4347 |
| 0.9593 | −0.0476 | 9.4347 |
| 0.7571 | 0.0194 | 9.4347 |
| 0.5536 | 0.0832 | 9.4347 |
| 0.3491 | 0.1436 | 9.4347 |
| 0.1438 | 0.2002 | 9.4347 |
| −0.0621 | 0.2528 | 9.4347 |
| −0.2688 | 0.3009 | 9.4347 |
| −0.4763 | 0.3445 | 9.4347 |
| −0.6846 | 0.3833 | 9.4347 |
| −0.8938 | 0.4167 | 9.4347 |
| −1.0970 | 0.4434 | 9.4347 |
| −1.2941 | 0.4636 | 9.4347 |
| −1.4852 | 0.4774 | 9.4347 |
| −1.6702 | 0.4848 | 9.4347 |
| −1.8489 | 0.4859 | 9.4347 |
| −2.0203 | 0.4809 | 9.4347 |
| −2.1843 | 0.4704 | 9.4347 |
| −2.3408 | 0.4545 | 9.4347 |
| −2.4823 | 0.4346 | 9.4347 |
| −2.6090 | 0.4119 | 9.4347 |
| −2.7208 | 0.3873 | 9.4347 |
| −2.8244 | 0.3596 | 9.4347 |
| −2.9128 | 0.3308 | 9.4347 |
| −2.9795 | 0.3050 | 9.4347 |
| −3.0303 | 0.2791 | 9.4347 |
| −3.0643 | 0.2530 | 9.4347 |
| −3.0843 | 0.2278 | 9.4347 |
| −3.0912 | 0.2113 | 9.4347 |
| −3.0930 | 0.1999 | 9.4347 |
| −3.0929 | 0.1941 | 9.4347 |

TABLE A-continued

| X | Y | Z |
|---|---|---|
| −3.0926 | 0.1913 | 9.4347 |
| −2.9962 | 0.1540 | 10.9347 |
| −2.9959 | 0.1526 | 10.9347 |
| −2.9953 | 0.1500 | 10.9347 |
| −2.9935 | 0.1450 | 10.9347 |
| −2.9881 | 0.1356 | 10.9347 |
| −2.9765 | 0.1236 | 10.9347 |
| −2.9505 | 0.1085 | 10.9347 |
| −2.9124 | 0.0969 | 10.9347 |
| −2.8597 | 0.0898 | 10.9347 |
| −2.7933 | 0.0857 | 10.9347 |
| −2.7068 | 0.0818 | 10.9347 |
| −2.6070 | 0.0783 | 10.9347 |
| −2.5006 | 0.0746 | 10.9347 |
| −2.3809 | 0.0696 | 10.9347 |
| −2.2480 | 0.0628 | 10.9347 |
| −2.1019 | 0.0539 | 10.9347 |
| −1.9494 | 0.0430 | 10.9347 |
| −1.7903 | 0.0297 | 10.9347 |
| −1.6248 | 0.0142 | 10.9347 |
| −1.4527 | −0.0035 | 10.9347 |
| −1.2741 | −0.0233 | 10.9347 |
| −1.0891 | −0.0454 | 10.9347 |
| −0.8978 | −0.0698 | 10.9347 |
| −0.7003 | −0.0972 | 10.9347 |
| −0.5031 | −0.1267 | 10.9347 |
| −0.3063 | −0.1586 | 10.9347 |
| −0.1099 | −0.1924 | 10.9347 |
| 0.0862 | −0.2280 | 10.9347 |
| 0.2820 | −0.2653 | 10.9347 |
| 0.4775 | −0.3042 | 10.9347 |
| 0.6728 | −0.3447 | 10.9347 |
| 0.8678 | −0.3866 | 10.9347 |
| 1.0625 | −0.4299 | 10.9347 |
| 1.2570 | −0.4744 | 10.9347 |
| 1.4512 | −0.5203 | 10.9347 |
| 1.6386 | −0.5660 | 10.9347 |
| 1.8192 | −0.6113 | 10.9347 |
| 1.9930 | −0.6564 | 10.9347 |
| 2.1601 | −0.7009 | 10.9347 |
| 2.3204 | −0.7450 | 10.9347 |
| 2.4740 | −0.7884 | 10.9347 |
| 2.6210 | −0.8311 | 10.9347 |
| 2.7548 | −0.8710 | 10.9347 |
| 2.8757 | −0.9080 | 10.9347 |
| 2.9836 | −0.9419 | 10.9347 |
| 3.0786 | −0.9724 | 10.9347 |
| 3.1607 | −0.9995 | 10.9347 |
| 3.2300 | −1.0229 | 10.9347 |
| 3.2892 | −1.0433 | 10.9347 |
| 3.3388 | −1.0605 | 10.9347 |
| 3.3796 | −1.0749 | 10.9347 |
| 3.4122 | −1.0865 | 10.9347 |
| 3.4376 | −1.0938 | 10.9347 |
| 3.4570 | −1.0911 | 10.9347 |
| 3.4712 | −1.0828 | 10.9347 |
| 3.4798 | −1.0728 | 10.9347 |
| 3.4842 | −1.0639 | 10.9347 |
| 3.4867 | −1.0539 | 10.9347 |
| 3.4865 | −1.0402 | 10.9347 |
| 3.4806 | −1.0242 | 10.9347 |
| 3.4666 | −1.0092 | 10.9347 |
| 3.4416 | −0.9982 | 10.9347 |
| 3.4086 | −0.9852 | 10.9347 |
| 3.3674 | −0.9689 | 10.9347 |
| 3.3173 | −0.9491 | 10.9347 |
| 3.2577 | −0.9255 | 10.9347 |
| 3.1881 | −0.8977 | 10.9347 |
| 3.1059 | −0.8646 | 10.9347 |
| 3.0110 | −0.8262 | 10.9347 |
| 2.9036 | −0.7827 | 10.9347 |
| 2.7836 | −0.7340 | 10.9347 |
| 2.6508 | −0.6804 | 10.9347 |
| 2.5052 | −0.6221 | 10.9347 |
| 2.3531 | −0.5617 | 10.9347 |
| 2.1944 | −0.4996 | 10.9347 |
| 2.0290 | −0.4360 | 10.9347 |
| 1.8568 | −0.3712 | 10.9347 |

TABLE A-continued

| X | Y | Z |
|---|---|---|
| 1.6779 | −0.3054 | 10.9347 |
| 1.4922 | −0.2391 | 10.9347 |
| 1.2995 | −0.1725 | 10.9347 |
| 1.1062 | −0.1082 | 10.9347 |
| 0.9122 | −0.0463 | 10.9347 |
| 0.7176 | 0.0130 | 10.9347 |
| 0.5221 | 0.0695 | 10.9347 |
| 0.3259 | 0.1229 | 10.9347 |
| 0.1288 | 0.1730 | 10.9347 |
| −0.0692 | 0.2197 | 10.9347 |
| −0.2683 | 0.2626 | 10.9347 |
| −0.4684 | 0.3016 | 10.9347 |
| −0.6697 | 0.3362 | 10.9347 |
| −0.8722 | 0.3663 | 10.9347 |
| −1.0693 | 0.3903 | 10.9347 |
| −1.2608 | 0.4084 | 10.9347 |
| −1.4457 | 0.4207 | 10.9347 |
| −1.6241 | 0.4272 | 10.9347 |
| −1.7959 | 0.4280 | 10.9347 |
| −1.9607 | 0.4232 | 10.9347 |
| −2.1183 | 0.4134 | 10.9347 |
| −2.2688 | 0.3987 | 10.9347 |
| −2.4050 | 0.3804 | 10.9347 |
| −2.5270 | 0.3594 | 10.9347 |
| −2.6346 | 0.3368 | 10.9347 |
| −2.7345 | 0.3113 | 10.9347 |
| −2.8199 | 0.2849 | 10.9347 |
| −2.8845 | 0.2613 | 10.9347 |
| −2.9340 | 0.2377 | 10.9347 |
| −2.9675 | 0.2138 | 10.9347 |
| −2.9875 | 0.1902 | 10.9347 |
| −2.9947 | 0.1745 | 10.9347 |
| −2.9967 | 0.1637 | 10.9347 |
| −2.9967 | 0.1581 | 10.9347 |
| −2.9964 | 0.1553 | 10.9347 |
| −2.8093 | 0.0865 | 13.9347 |
| −2.8091 | 0.0853 | 13.9347 |
| −2.8084 | 0.0829 | 13.9347 |
| −2.8067 | 0.0782 | 13.9347 |
| −2.8014 | 0.0698 | 13.9347 |
| −2.7899 | 0.0594 | 13.9347 |
| −2.7651 | 0.0469 | 13.9347 |
| −2.7292 | 0.0383 | 13.9347 |
| −2.6801 | 0.0341 | 13.9347 |
| −2.6186 | 0.0323 | 13.9347 |
| −2.5386 | 0.0310 | 13.9347 |
| −2.4462 | 0.0302 | 13.9347 |
| −2.3477 | 0.0293 | 13.9347 |
| −2.2369 | 0.0275 | 13.9347 |
| −2.1139 | 0.0244 | 13.9347 |
| −1.9786 | 0.0198 | 13.9347 |
| −1.8372 | 0.0135 | 13.9347 |
| −1.6897 | 0.0054 | 13.9347 |
| −1.5361 | −0.0047 | 13.9347 |
| −1.3765 | −0.0164 | 13.9347 |
| −1.2108 | −0.0298 | 13.9347 |
| −1.0392 | −0.0449 | 13.9347 |
| −0.8616 | −0.0620 | 13.9347 |
| −0.6781 | −0.0812 | 13.9347 |
| −0.4948 | −0.1024 | 13.9347 |
| −0.3117 | −0.1254 | 13.9347 |
| −0.1287 | −0.1501 | 13.9347 |
| 0.0540 | −0.1762 | 13.9347 |
| 0.2366 | −0.2037 | 13.9347 |
| 0.4191 | −0.2325 | 13.9347 |
| 0.6013 | −0.2625 | 13.9347 |
| 0.7833 | −0.2937 | 13.9347 |
| 0.9651 | −0.3259 | 13.9347 |
| 1.1467 | −0.3592 | 13.9347 |
| 1.3281 | −0.3936 | 13.9347 |
| 1.5033 | −0.4278 | 13.9347 |
| 1.6723 | −0.4619 | 13.9347 |
| 1.8350 | −0.4957 | 13.9347 |
| 1.9916 | −0.5293 | 13.9347 |
| 2.1419 | −0.5624 | 13.9347 |
| 2.2859 | −0.5951 | 13.9347 |
| 2.4238 | −0.6273 | 13.9347 |
| 2.5496 | −0.6575 | 13.9347 |

TABLE A-continued

| X | Y | Z |
|---|---|---|
| 2.6632 | −0.6854 | 13.9347 |
| 2.7647 | −0.7110 | 13.9347 |
| 2.8541 | −0.7341 | 13.9347 |
| 2.9314 | −0.7546 | 13.9347 |
| 2.9968 | −0.7723 | 13.9347 |
| 3.0526 | −0.7877 | 13.9347 |
| 3.0994 | −0.8008 | 13.9347 |
| 3.1380 | −0.8117 | 13.9347 |
| 3.1687 | −0.8205 | 13.9347 |
| 3.1926 | −0.8265 | 13.9347 |
| 3.2109 | −0.8238 | 13.9347 |
| 3.2239 | −0.8156 | 13.9347 |
| 3.2315 | −0.8058 | 13.9347 |
| 3.2351 | −0.7973 | 13.9347 |
| 3.2367 | −0.7879 | 13.9347 |
| 3.2354 | −0.7754 | 13.9347 |
| 3.2286 | −0.7612 | 13.9347 |
| 3.2142 | −0.7490 | 13.9347 |
| 3.1904 | −0.7408 | 13.9347 |
| 3.1594 | −0.7309 | 13.9347 |
| 3.1205 | −0.7185 | 13.9347 |
| 3.0733 | −0.7034 | 13.9347 |
| 3.0171 | −0.6855 | 13.9347 |
| 2.9514 | −0.6645 | 13.9347 |
| 2.8738 | −0.6395 | 13.9347 |
| 2.7843 | −0.6104 | 13.9347 |
| 2.6829 | −0.5774 | 13.9347 |
| 2.5695 | −0.5406 | 13.9347 |
| 2.4442 | −0.5000 | 13.9347 |
| 2.3068 | −0.4558 | 13.9347 |
| 2.1634 | −0.4101 | 13.9347 |
| 2.0137 | −0.3631 | 13.9347 |
| 1.8579 | −0.3150 | 13.9347 |
| 1.6959 | −0.2659 | 13.9347 |
| 1.5278 | −0.2163 | 13.9347 |
| 1.3534 | −0.1662 | 13.9347 |
| 1.1727 | −0.1159 | 13.9347 |
| 0.9917 | −0.0674 | 13.9347 |
| 0.8104 | −0.0207 | 13.9347 |
| 0.6287 | 0.0239 | 13.9347 |
| 0.4467 | 0.0663 | 13.9347 |
| 0.2643 | 0.1063 | 13.9347 |
| 0.0814 | 0.1438 | 13.9347 |
| −0.1019 | 0.1786 | 13.9347 |
| −0.2858 | 0.2104 | 13.9347 |
| −0.4701 | 0.2391 | 13.9347 |
| −0.6551 | 0.2644 | 13.9347 |
| −0.8406 | 0.2861 | 13.9347 |
| −1.0207 | 0.3032 | 13.9347 |
| −1.1951 | 0.3159 | 13.9347 |
| −1.3641 | 0.3241 | 13.9347 |
| −1.5274 | 0.3279 | 13.9347 |
| −1.6853 | 0.3272 | 13.9347 |
| −1.8376 | 0.3220 | 13.9347 |
| −1.9842 | 0.3126 | 13.9347 |
| −2.1243 | 0.2993 | 13.9347 |
| −2.2513 | 0.2830 | 13.9347 |
| −2.3650 | 0.2646 | 13.9347 |
| −2.4655 | 0.2449 | 13.9347 |
| −2.5590 | 0.2229 | 13.9347 |
| −2.6390 | 0.2003 | 13.9347 |
| −2.6998 | 0.1802 | 13.9347 |
| −2.7470 | 0.1606 | 13.9347 |
| −2.7795 | 0.1402 | 13.9347 |
| −2.7996 | 0.1196 | 13.9347 |
| −2.8072 | 0.1055 | 13.9347 |
| −2.8096 | 0.0955 | 13.9347 |
| −2.8097 | 0.0904 | 13.9347 |
| −2.8095 | 0.0878 | 13.9347 |
| −2.7157 | 0.0569 | 15.4347 |
| −2.7154 | 0.0557 | 15.4347 |
| −2.7148 | 0.0534 | 15.4347 |
| −2.7131 | 0.0490 | 15.4347 |
| −2.7079 | 0.0410 | 15.4347 |
| −2.6967 | 0.0312 | 15.4347 |
| −2.6726 | 0.0198 | 15.4347 |
| −2.6379 | 0.0122 | 15.4347 |
| −2.5907 | 0.0089 | 15.4347 |

TABLE A-continued

| X | Y | Z |
|---|---|---|
| −2.5316 | 0.0077 | 15.4347 |
| −2.4548 | 0.0071 | 15.4347 |
| −2.3661 | 0.0071 | 15.4347 |
| −2.2715 | 0.0072 | 15.4347 |
| −2.1651 | 0.0065 | 15.4347 |
| −2.0469 | 0.0048 | 15.4347 |
| −1.9169 | 0.0019 | 15.4347 |
| −1.7810 | −0.0024 | 15.4347 |
| −1.6392 | −0.0084 | 15.4347 |
| −1.4916 | −0.0159 | 15.4347 |
| −1.3382 | −0.0249 | 15.4347 |
| −1.1789 | −0.0352 | 15.4347 |
| −1.0139 | −0.0470 | 15.4347 |
| −0.8430 | −0.0604 | 15.4347 |
| −0.6664 | −0.0757 | 15.4347 |
| −0.4900 | −0.0927 | 15.4347 |
| −0.3137 | −0.1113 | 15.4347 |
| −0.1375 | −0.1312 | 15.4347 |
| 0.0386 | −0.1524 | 15.4347 |
| 0.2146 | −0.1749 | 15.4347 |
| 0.3904 | −0.1984 | 15.4347 |
| 0.5660 | −0.2230 | 15.4347 |
| 0.7415 | −0.2486 | 15.4347 |
| 0.9168 | −0.2751 | 15.4347 |
| 1.0920 | −0.3025 | 15.4347 |
| 1.2671 | −0.3308 | 15.4347 |
| 1.4362 | −0.3591 | 15.4347 |
| 1.5993 | −0.3873 | 15.4347 |
| 1.7565 | −0.4153 | 15.4347 |
| 1.9077 | −0.4432 | 15.4347 |
| 2.0529 | −0.4707 | 15.4347 |
| 2.1922 | −0.4980 | 15.4347 |
| 2.3255 | −0.5248 | 15.4347 |
| 2.4471 | −0.5500 | 15.4347 |
| 2.5570 | −0.5733 | 15.4347 |
| 2.6552 | −0.5947 | 15.4347 |
| 2.7417 | −0.6141 | 15.4347 |
| 2.8167 | −0.6313 | 15.4347 |
| 2.8800 | −0.6462 | 15.4347 |
| 2.9340 | −0.6591 | 15.4347 |
| 2.9794 | −0.6702 | 15.4347 |
| 3.0167 | −0.6793 | 15.4347 |
| 3.0466 | −0.6867 | 15.4347 |
| 3.0696 | −0.6917 | 15.4347 |
| 3.0867 | −0.6887 | 15.4347 |
| 3.0988 | −0.6805 | 15.4347 |
| 3.1057 | −0.6711 | 15.4347 |
| 3.1088 | −0.6629 | 15.4347 |
| 3.1100 | −0.6539 | 15.4347 |
| 3.1082 | −0.6419 | 15.4347 |
| 3.1010 | −0.6287 | 15.4347 |
| 3.0866 | −0.6178 | 15.4347 |
| 3.0635 | −0.6110 | 15.4347 |
| 3.0334 | −0.6025 | 15.4347 |
| 2.9958 | −0.5920 | 15.4347 |
| 2.9501 | −0.5793 | 15.4347 |
| 2.8957 | −0.5641 | 15.4347 |
| 2.8320 | −0.5462 | 15.4347 |
| 2.7568 | −0.5250 | 15.4347 |
| 2.6701 | −0.5003 | 15.4347 |
| 2.5719 | −0.4722 | 15.4347 |
| 2.4621 | −0.4409 | 15.4347 |
| 2.3407 | −0.4063 | 15.4347 |
| 2.2077 | −0.3687 | 15.4347 |
| 2.0688 | −0.3298 | 15.4347 |
| 1.9240 | −0.2898 | 15.4347 |
| 1.7733 | −0.2489 | 15.4347 |
| 1.6166 | −0.2072 | 15.4347 |
| 1.4539 | −0.1649 | 15.4347 |
| 1.2853 | −0.1223 | 15.4347 |
| 1.1106 | −0.0796 | 15.4347 |
| 0.9357 | −0.0383 | 15.4347 |
| 0.7605 | 0.0013 | 15.4347 |
| 0.5850 | 0.0391 | 15.4347 |
| 0.4091 | 0.0751 | 15.4347 |
| 0.2330 | 0.1089 | 15.4347 |
| 0.0564 | 0.1406 | 15.4347 |
| −0.1205 | 0.1698 | 15.4347 |

TABLE A-continued

| X | Y | Z |
|---|---|---|
| −0.2979 | 0.1964 | 15.4347 |
| −0.4757 | 0.2202 | 15.4347 |
| −0.6541 | 0.2410 | 15.4347 |
| −0.8329 | 0.2587 | 15.4347 |
| −1.0064 | 0.2722 | 15.4347 |
| −1.1745 | 0.2818 | 15.4347 |
| −1.3372 | 0.2875 | 15.4347 |
| −1.4945 | 0.2893 | 15.4347 |
| −1.6463 | 0.2870 | 15.4347 |
| −1.7919 | 0.2807 | 15.4347 |
| −1.9312 | 0.2707 | 15.4347 |
| −2.0642 | 0.2573 | 15.4347 |
| −2.1846 | 0.2414 | 15.4347 |
| −2.2925 | 0.2237 | 15.4347 |
| −2.3879 | 0.2050 | 15.4347 |
| −2.4767 | 0.1843 | 15.4347 |
| −2.5528 | 0.1631 | 15.4347 |
| −2.6106 | 0.1443 | 15.4347 |
| −2.6556 | 0.1262 | 15.4347 |
| −2.6867 | 0.1074 | 15.4347 |
| −2.7061 | 0.0882 | 15.4347 |
| −2.7136 | 0.0749 | 15.4347 |
| −2.7159 | 0.0654 | 15.4347 |
| −2.7161 | 0.0606 | 15.4347 |
| −2.7158 | 0.0581 | 15.4347 |
| −2.6214 | 0.0300 | 16.9347 |
| −2.6212 | 0.0288 | 16.9347 |
| −2.6206 | 0.0266 | 16.9347 |
| −2.6189 | 0.0224 | 16.9347 |
| −2.6138 | 0.0148 | 16.9347 |
| −2.6029 | 0.0056 | 16.9347 |
| −2.5795 | −0.0049 | 16.9347 |
| −2.5462 | −0.0116 | 16.9347 |
| −2.5009 | −0.0142 | 16.9347 |
| −2.4442 | −0.0149 | 16.9347 |
| −2.3706 | −0.0149 | 16.9347 |
| −2.2855 | −0.0142 | 16.9347 |
| −2.1949 | −0.0134 | 16.9347 |
| −2.0928 | −0.0131 | 16.9347 |
| −1.9795 | −0.0136 | 16.9347 |
| −1.8548 | −0.0149 | 16.9347 |
| −1.7245 | −0.0174 | 16.9347 |
| −1.5885 | −0.0213 | 16.9347 |
| −1.4469 | −0.0264 | 16.9347 |
| −1.2997 | −0.0327 | 16.9347 |
| −1.1468 | −0.0401 | 16.9347 |
| −0.9884 | −0.0487 | 16.9347 |
| −0.8244 | −0.0585 | 16.9347 |
| −0.6548 | −0.0699 | 16.9347 |
| −0.4853 | −0.0827 | 16.9347 |
| −0.3159 | −0.0969 | 16.9347 |
| −0.1465 | −0.1122 | 16.9347 |
| 0.0227 | −0.1286 | 16.9347 |
| 0.1919 | −0.1460 | 16.9347 |
| 0.3609 | −0.1644 | 16.9347 |
| 0.5299 | −0.1837 | 16.9347 |
| 0.6987 | −0.2037 | 16.9347 |
| 0.8675 | −0.2246 | 16.9347 |
| 1.0361 | −0.2462 | 16.9347 |
| 1.2047 | −0.2686 | 16.9347 |
| 1.3675 | −0.2910 | 16.9347 |
| 1.5246 | −0.3133 | 16.9347 |
| 1.6761 | −0.3356 | 16.9347 |
| 1.8218 | −0.3578 | 16.9347 |
| 1.9617 | −0.3799 | 16.9347 |
| 2.0960 | −0.4017 | 16.9347 |
| 2.2246 | −0.4233 | 16.9347 |
| 2.3419 | −0.4435 | 16.9347 |
| 2.4480 | −0.4624 | 16.9347 |
| 2.5428 | −0.4797 | 16.9347 |
| 2.6263 | −0.4954 | 16.9347 |
| 2.6987 | −0.5094 | 16.9347 |
| 2.7599 | −0.5215 | 16.9347 |
| 2.8121 | −0.5321 | 16.9347 |
| 2.8559 | −0.5411 | 16.9347 |
| 2.8920 | −0.5486 | 16.9347 |
| 2.9209 | −0.5547 | 16.9347 |
| 2.9431 | −0.5590 | 16.9347 |

TABLE A-continued

| X | Y | Z |
|---|---|---|
| 2.9597 | −0.5560 | 16.9347 |
| 2.9713 | −0.5480 | 16.9347 |
| 2.9777 | −0.5387 | 16.9347 |
| 2.9805 | −0.5307 | 16.9347 |
| 2.9813 | −0.5220 | 16.9347 |
| 2.9792 | −0.5106 | 16.9347 |
| 2.9716 | −0.4983 | 16.9347 |
| 2.9572 | −0.4887 | 16.9347 |
| 2.9349 | −0.4832 | 16.9347 |
| 2.9058 | −0.4762 | 16.9347 |
| 2.8695 | −0.4675 | 16.9347 |
| 2.8253 | −0.4569 | 16.9347 |
| 2.7727 | −0.4443 | 16.9347 |
| 2.7112 | −0.4295 | 16.9347 |
| 2.6385 | −0.4119 | 16.9347 |
| 2.5547 | −0.3913 | 16.9347 |
| 2.4598 | −0.3679 | 16.9347 |
| 2.3537 | −0.3418 | 16.9347 |
| 2.2364 | −0.3130 | 16.9347 |
| 2.1079 | −0.2816 | 16.9347 |
| 1.9737 | −0.2492 | 16.9347 |
| 1.8339 | −0.2159 | 16.9347 |
| 1.6883 | −0.1817 | 16.9347 |
| 1.5371 | −0.1470 | 16.9347 |
| 1.3801 | −0.1118 | 16.9347 |
| 1.2174 | −0.0763 | 16.9347 |
| 1.0488 | −0.0407 | 16.9347 |
| 0.8801 | −0.0065 | 16.9347 |
| 0.7111 | 0.0264 | 16.9347 |
| 0.5419 | 0.0578 | 16.9347 |
| 0.3724 | 0.0875 | 16.9347 |
| 0.2027 | 0.1154 | 16.9347 |
| 0.0326 | 0.1413 | 16.9347 |
| −0.1378 | 0.1651 | 16.9347 |
| −0.3086 | 0.1867 | 16.9347 |
| −0.4798 | 0.2057 | 16.9347 |
| −0.6514 | 0.2221 | 16.9347 |
| −0.8234 | 0.2356 | 16.9347 |
| −0.9902 | 0.2456 | 16.9347 |
| −1.1518 | 0.2522 | 16.9347 |
| −1.3078 | 0.2553 | 16.9347 |
| −1.4581 | 0.2549 | 16.9347 |
| −1.6025 | 0.2510 | 16.9347 |
| −1.7411 | 0.2436 | 16.9347 |
| −1.8736 | 0.2330 | 16.9347 |
| −2.0001 | 0.2195 | 16.9347 |
| −2.1147 | 0.2039 | 16.9347 |
| −2.2173 | 0.1867 | 16.9347 |
| −2.3081 | 0.1689 | 16.9347 |
| −2.3926 | 0.1493 | 16.9347 |
| −2.4651 | 0.1293 | 16.9347 |
| −2.5202 | 0.1118 | 16.9347 |
| −2.5633 | 0.0950 | 16.9347 |
| −2.5931 | 0.0776 | 16.9347 |
| −2.6119 | 0.0596 | 16.9347 |
| −2.6192 | 0.0471 | 16.9347 |
| −2.6216 | 0.0381 | 16.9347 |
| −2.6218 | 0.0334 | 16.9347 |
| −2.6216 | 0.0311 | 16.9347 |
| −2.5283 | 0.0052 | 18.4347 |
| −2.5281 | 0.0041 | 18.4347 |
| −2.5275 | 0.0020 | 18.4347 |
| −2.5259 | −0.0020 | 18.4347 |
| −2.5209 | −0.0093 | 18.4347 |
| −2.5104 | −0.0180 | 18.4347 |
| −2.4880 | −0.0280 | 18.4347 |
| −2.4560 | −0.0342 | 18.4347 |
| −2.4126 | −0.0365 | 18.4347 |
| −2.3584 | −0.0371 | 18.4347 |
| −2.2878 | −0.0369 | 18.4347 |
| −2.2064 | −0.0359 | 18.4347 |
| −2.1195 | −0.0347 | 18.4347 |
| −2.0218 | −0.0337 | 18.4347 |
| −1.9132 | −0.0332 | 18.4347 |
| −1.7938 | −0.0332 | 18.4347 |
| −1.6689 | −0.0342 | 18.4347 |
| −1.5386 | −0.0361 | 18.4347 |
| −1.4029 | −0.0390 | 18.4347 |

TABLE A-continued

| X | Y | Z |
|---|---|---|
| −1.2618 | −0.0427 | 18.4347 |
| −1.1153 | −0.0473 | 18.4347 |
| −0.9634 | −0.0526 | 18.4347 |
| −0.8062 | −0.0590 | 18.4347 |
| −0.6435 | −0.0664 | 18.4347 |
| −0.4809 | −0.0751 | 18.4347 |
| −0.3183 | −0.0850 | 18.4347 |
| −0.1558 | −0.0957 | 18.4347 |
| 0.0067 | −0.1074 | 18.4347 |
| 0.1691 | −0.1199 | 18.4347 |
| 0.3314 | −0.1331 | 18.4347 |
| 0.4937 | −0.1471 | 18.4347 |
| 0.6559 | −0.1617 | 18.4347 |
| 0.8180 | −0.1770 | 18.4347 |
| 0.9801 | −0.1929 | 18.4347 |
| 1.1422 | −0.2094 | 18.4347 |
| 1.2987 | −0.2261 | 18.4347 |
| 1.4499 | −0.2427 | 18.4347 |
| 1.5955 | −0.2594 | 18.4347 |
| 1.7357 | −0.2761 | 18.4347 |
| 1.8704 | −0.2928 | 18.4347 |
| 1.9996 | −0.3094 | 18.4347 |
| 2.1234 | −0.3258 | 18.4347 |
| 2.2364 | −0.3413 | 18.4347 |
| 2.3385 | −0.3558 | 18.4347 |
| 2.4299 | −0.3692 | 18.4347 |
| 2.5104 | −0.3814 | 18.4347 |
| 2.5801 | −0.3923 | 18.4347 |
| 2.6391 | −0.4018 | 18.4347 |
| 2.6895 | −0.4101 | 18.4347 |
| 2.7318 | −0.4172 | 18.4347 |
| 2.7666 | −0.4231 | 18.4347 |
| 2.7944 | −0.4279 | 18.4347 |
| 2.8158 | −0.4314 | 18.4347 |
| 2.8317 | −0.4285 | 18.4347 |
| 2.8427 | −0.4206 | 18.4347 |
| 2.8487 | −0.4115 | 18.4347 |
| 2.8511 | −0.4037 | 18.4347 |
| 2.8515 | −0.3954 | 18.4347 |
| 2.8490 | −0.3846 | 18.4347 |
| 2.8411 | −0.3732 | 18.4347 |
| 2.8268 | −0.3649 | 18.4347 |
| 2.8053 | −0.3605 | 18.4347 |
| 2.7772 | −0.3549 | 18.4347 |
| 2.7421 | −0.3479 | 18.4347 |
| 2.6995 | −0.3394 | 18.4347 |
| 2.6488 | −0.3292 | 18.4347 |
| 2.5895 | −0.3172 | 18.4347 |
| 2.5195 | −0.3029 | 18.4347 |
| 2.4386 | −0.2862 | 18.4347 |
| 2.3471 | −0.2672 | 18.4347 |
| 2.2448 | −0.2459 | 18.4347 |
| 2.1316 | −0.2224 | 18.4347 |
| 2.0077 | −0.1968 | 18.4347 |
| 1.8784 | −0.1703 | 18.4347 |
| 1.7436 | −0.1431 | 18.4347 |
| 1.6034 | −0.1152 | 18.4347 |
| 1.4577 | −0.0868 | 18.4347 |
| 1.3065 | −0.0581 | 18.4347 |
| 1.1497 | −0.0292 | 18.4347 |
| 0.9875 | −0.0002 | 18.4347 |
| 0.8250 | 0.0277 | 18.4347 |
| 0.6624 | 0.0544 | 18.4347 |
| 0.4996 | 0.0798 | 18.4347 |
| 0.3367 | 0.1037 | 18.4347 |
| 0.1735 | 0.1261 | 18.4347 |
| 0.0100 | 0.1468 | 18.4347 |
| −0.1537 | 0.1656 | 18.4347 |
| −0.3177 | 0.1824 | 18.4347 |
| −0.4821 | 0.1969 | 18.4347 |
| −0.6467 | 0.2092 | 18.4347 |
| −0.8117 | 0.2189 | 18.4347 |
| −0.9716 | 0.2255 | 18.4347 |
| −1.1260 | 0.2292 | 18.4347 |
| −1.2749 | 0.2298 | 18.4347 |
| −1.4184 | 0.2274 | 18.4347 |
| −1.5562 | 0.2219 | 18.4347 |
| −1.6883 | 0.2133 | 18.4347 |

TABLE A-continued

| X | Y | Z |
|---|---|---|
| −1.8147 | 0.2020 | 18.4347 |
| −1.9354 | 0.1880 | 18.4347 |
| −2.0446 | 0.1724 | 18.4347 |
| −2.1425 | 0.1554 | 18.4347 |
| −2.2291 | 0.1380 | 18.4347 |
| −2.3097 | 0.1190 | 18.4347 |
| −2.3788 | 0.0998 | 18.4347 |
| −2.4314 | 0.0829 | 18.4347 |
| −2.4725 | 0.0670 | 18.4347 |
| −2.5012 | 0.0504 | 18.4347 |
| −2.5192 | 0.0334 | 18.4347 |
| −2.5262 | 0.0215 | 18.4347 |
| −2.5284 | 0.0129 | 18.4347 |
| −2.5286 | 0.0085 | 18.4347 |
| −2.5284 | 0.0063 | 18.4347 |
| −2.4751 | −0.0060 | 19.1847 |
| −2.4748 | −0.0071 | 19.1847 |
| −2.4743 | −0.0091 | 19.1847 |
| −2.4727 | −0.0131 | 19.1847 |
| −2.4679 | −0.0202 | 19.1847 |
| −2.4578 | −0.0288 | 19.1847 |
| −2.4360 | −0.0387 | 19.1847 |
| −2.4048 | −0.0449 | 19.1847 |
| −2.3624 | −0.0474 | 19.1847 |
| −2.3094 | −0.0483 | 19.1847 |
| −2.2405 | −0.0483 | 19.1847 |
| −2.1610 | −0.0474 | 19.1847 |
| −2.0761 | −0.0461 | 19.1847 |
| −1.9807 | −0.0451 | 19.1847 |
| −1.8747 | −0.0443 | 19.1847 |
| −1.7580 | −0.0440 | 19.1847 |
| −1.6361 | −0.0444 | 19.1847 |
| −1.5088 | −0.0456 | 19.1847 |
| −1.3763 | −0.0476 | 19.1847 |
| −1.2384 | −0.0502 | 19.1847 |
| −1.0953 | −0.0534 | 19.1847 |
| −0.9469 | −0.0573 | 19.1847 |
| −0.7933 | −0.0620 | 19.1847 |
| −0.6343 | −0.0676 | 19.1847 |
| −0.4754 | −0.0743 | 19.1847 |
| −0.3166 | −0.0820 | 19.1847 |
| −0.1577 | −0.0905 | 19.1847 |
| 0.0011 | −0.0998 | 19.1847 |
| 0.1599 | −0.1098 | 19.1847 |
| 0.3186 | −0.1205 | 19.1847 |
| 0.4772 | −0.1318 | 19.1847 |
| 0.6359 | −0.1437 | 19.1847 |
| 0.7944 | −0.1561 | 19.1847 |
| 0.9530 | −0.1691 | 19.1847 |
| 1.1115 | −0.1827 | 19.1847 |
| 1.2646 | −0.1963 | 19.1847 |
| 1.4125 | −0.2101 | 19.1847 |
| 1.5550 | −0.2240 | 19.1847 |
| 1.6921 | −0.2379 | 19.1847 |
| 1.8240 | −0.2518 | 19.1847 |
| 1.9505 | −0.2658 | 19.1847 |
| 2.0716 | −0.2797 | 19.1847 |
| 2.1822 | −0.2928 | 19.1847 |
| 2.2822 | −0.3051 | 19.1847 |
| 2.3716 | −0.3166 | 19.1847 |
| 2.4505 | −0.3270 | 19.1847 |
| 2.5188 | −0.3364 | 19.1847 |
| 2.5765 | −0.3447 | 19.1847 |
| 2.6259 | −0.3519 | 19.1847 |
| 2.6673 | −0.3580 | 19.1847 |
| 2.7014 | −0.3632 | 19.1847 |
| 2.7286 | −0.3674 | 19.1847 |
| 2.7496 | −0.3705 | 19.1847 |
| 2.7651 | −0.3675 | 19.1847 |
| 2.7758 | −0.3597 | 19.1847 |
| 2.7815 | −0.3507 | 19.1847 |
| 2.7837 | −0.3431 | 19.1847 |
| 2.7840 | −0.3350 | 19.1847 |
| 2.7812 | −0.3245 | 19.1847 |
| 2.7733 | −0.3135 | 19.1847 |
| 2.7591 | −0.3059 | 19.1847 |
| 2.7379 | −0.3020 | 19.1847 |
| 2.7105 | −0.2971 | 19.1847 |

TABLE A-continued

| X | Y | Z |
|---|---|---|
| 2.6761 | −0.2908 | 19.1847 |
| 2.6344 | −0.2832 | 19.1847 |
| 2.5847 | −0.2742 | 19.1847 |
| 2.5266 | −0.2635 | 19.1847 |
| 2.4580 | −0.2507 | 19.1847 |
| 2.3788 | −0.2358 | 19.1847 |
| 2.2892 | −0.2187 | 19.1847 |
| 2.1889 | −0.1996 | 19.1847 |
| 2.0782 | −0.1785 | 19.1847 |
| 1.9568 | −0.1555 | 19.1847 |
| 1.8301 | −0.1317 | 19.1847 |
| 1.6982 | −0.1072 | 19.1847 |
| 1.5608 | −0.0821 | 19.1847 |
| 1.4182 | −0.0566 | 19.1847 |
| 1.2701 | −0.0308 | 19.1847 |
| 1.1167 | −0.0048 | 19.1847 |
| 0.9579 | 0.0212 | 19.1847 |
| 0.7989 | 0.0462 | 19.1847 |
| 0.6398 | 0.0701 | 19.1847 |
| 0.4805 | 0.0928 | 19.1847 |
| 0.3211 | 0.1141 | 19.1847 |
| 0.1614 | 0.1340 | 19.1847 |
| 0.0016 | 0.1523 | 19.1847 |
| −0.1585 | 0.1688 | 19.1847 |
| −0.3189 | 0.1835 | 19.1847 |
| −0.4795 | 0.1959 | 19.1847 |
| −0.6404 | 0.2063 | 19.1847 |
| −0.8016 | 0.2142 | 19.1847 |
| −0.9577 | 0.2193 | 19.1847 |
| −1.1083 | 0.2215 | 19.1847 |
| −1.2536 | 0.2209 | 19.1847 |
| −1.3935 | 0.2175 | 19.1847 |
| −1.5280 | 0.2111 | 19.1847 |
| −1.6568 | 0.2019 | 19.1847 |
| −1.7801 | 0.1900 | 19.1847 |
| −1.8977 | 0.1756 | 19.1847 |
| −2.0042 | 0.1598 | 19.1847 |
| −2.0996 | 0.1427 | 19.1847 |
| −2.1840 | 0.1252 | 19.1847 |
| −2.2625 | 0.1063 | 19.1847 |
| −2.3298 | 0.0872 | 19.1847 |
| −2.3810 | 0.0704 | 19.1847 |
| −2.4211 | 0.0546 | 19.1847 |
| −2.4489 | 0.0384 | 19.1847 |
| −2.4663 | 0.0216 | 19.1847 |
| −2.4731 | 0.0099 | 19.1847 |
| −2.4752 | 0.0016 | 19.1847 |
| −2.4754 | −0.0027 | 19.1847 |
| −2.4752 | −0.0049 | 19.1847 |
| −2.4159 | −0.0161 | 19.9347 |
| −2.4157 | −0.0172 | 19.9347 |
| −2.4151 | −0.0192 | 19.9347 |
| −2.4136 | −0.0231 | 19.9347 |
| −2.4091 | −0.0300 | 19.9347 |
| −2.3993 | −0.0386 | 19.9347 |
| −2.3782 | −0.0486 | 19.9347 |
| −2.3479 | −0.0551 | 19.9347 |
| −2.3067 | −0.0579 | 19.9347 |
| −2.2551 | −0.0592 | 19.9347 |
| −2.1880 | −0.0596 | 19.9347 |
| −2.1105 | −0.0591 | 19.9347 |
| −2.0278 | −0.0581 | 19.9347 |
| −1.9349 | −0.0572 | 19.9347 |
| −1.8316 | −0.0564 | 19.9347 |
| −1.7179 | −0.0559 | 19.9347 |
| −1.5991 | −0.0559 | 19.9347 |
| −1.4752 | −0.0566 | 19.9347 |
| −1.3460 | −0.0578 | 19.9347 |
| −1.2117 | −0.0595 | 19.9347 |
| −1.0723 | −0.0615 | 19.9347 |
| −0.9277 | −0.0641 | 19.9347 |
| −0.7779 | −0.0671 | 19.9347 |
| −0.6230 | −0.0709 | 19.9347 |
| −0.4682 | −0.0757 | 19.9347 |
| −0.3133 | −0.0812 | 19.9347 |
| −0.1585 | −0.0875 | 19.9347 |
| −0.0037 | −0.0944 | 19.9347 |
| 0.1511 | −0.1019 | 19.9347 |

TABLE A-continued

| X | Y | Z |
|---|---|---|
| 0.3059 | −0.1099 | 19.9347 |
| 0.4606 | −0.1185 | 19.9347 |
| 0.6153 | −0.1276 | 19.9347 |
| 0.7700 | −0.1371 | 19.9347 |
| 0.9246 | −0.1472 | 19.9347 |
| 1.0792 | −0.1577 | 19.9347 |
| 1.2286 | −0.1684 | 19.9347 |
| 1.3729 | −0.1792 | 19.9347 |
| 1.5119 | −0.1902 | 19.9347 |
| 1.6458 | −0.2013 | 19.9347 |
| 1.7744 | −0.2125 | 19.9347 |
| 1.8979 | −0.2238 | 19.9347 |
| 2.0162 | −0.2351 | 19.9347 |
| 2.1241 | −0.2458 | 19.9347 |
| 2.2218 | −0.2560 | 19.9347 |
| 2.3091 | −0.2655 | 19.9347 |
| 2.3861 | −0.2742 | 19.9347 |
| 2.4528 | −0.2821 | 19.9347 |
| 2.5092 | −0.2891 | 19.9347 |
| 2.5573 | −0.2952 | 19.9347 |
| 2.5978 | −0.3004 | 19.9347 |
| 2.6311 | −0.3048 | 19.9347 |
| 2.6577 | −0.3084 | 19.9347 |
| 2.6782 | −0.3111 | 19.9347 |
| 2.6933 | −0.3080 | 19.9347 |
| 2.7035 | −0.3003 | 19.9347 |
| 2.7089 | −0.2915 | 19.9347 |
| 2.7109 | −0.2840 | 19.9347 |
| 2.7111 | −0.2761 | 19.9347 |
| 2.7082 | −0.2659 | 19.9347 |
| 2.7002 | −0.2555 | 19.9347 |
| 2.6861 | −0.2485 | 19.9347 |
| 2.6655 | −0.2451 | 19.9347 |
| 2.6386 | −0.2407 | 19.9347 |
| 2.6051 | −0.2352 | 19.9347 |
| 2.5643 | −0.2285 | 19.9347 |
| 2.5157 | −0.2205 | 19.9347 |
| 2.4590 | −0.2111 | 19.9347 |
| 2.3919 | −0.1997 | 19.9347 |
| 2.3146 | −0.1864 | 19.9347 |
| 2.2269 | −0.1712 | 19.9347 |
| 2.1290 | −0.1542 | 19.9347 |
| 2.0207 | −0.1353 | 19.9347 |
| 1.9022 | −0.1147 | 19.9347 |
| 1.7784 | −0.0934 | 19.9347 |
| 1.6495 | −0.0715 | 19.9347 |
| 1.5153 | −0.0490 | 19.9347 |
| 1.3759 | −0.0262 | 19.9347 |
| 1.2313 | −0.0030 | 19.9347 |
| 1.0813 | 0.0202 | 19.9347 |
| 0.9261 | 0.0435 | 19.9347 |
| 0.7707 | 0.0658 | 19.9347 |
| 0.6153 | 0.0872 | 19.9347 |
| 0.4596 | 0.1074 | 19.9347 |
| 0.3039 | 0.1263 | 19.9347 |
| 0.1479 | 0.1439 | 19.9347 |
| −0.0082 | 0.1599 | 19.9347 |
| −0.1645 | 0.1742 | 19.9347 |
| −0.3210 | 0.1868 | 19.9347 |
| −0.4776 | 0.1973 | 19.9347 |
| −0.6343 | 0.2057 | 19.9347 |
| −0.7911 | 0.2119 | 19.9347 |
| −0.9428 | 0.2155 | 19.9347 |
| −1.0894 | 0.2163 | 19.9347 |
| −1.2306 | 0.2145 | 19.9347 |
| −1.3666 | 0.2100 | 19.9347 |
| −1.4973 | 0.2027 | 19.9347 |
| −1.6225 | 0.1928 | 19.9347 |
| −1.7422 | 0.1802 | 19.9347 |
| −1.8564 | 0.1654 | 19.9347 |
| −1.9598 | 0.1492 | 19.9347 |
| −2.0524 | 0.1319 | 19.9347 |
| −2.1344 | 0.1144 | 19.9347 |
| −2.2105 | 0.0953 | 19.9347 |
| −2.2759 | 0.0762 | 19.9347 |
| −2.3255 | 0.0594 | 19.9347 |
| −2.3642 | 0.0436 | 19.9347 |
| −2.3910 | 0.0274 | 19.9347 |

TABLE A-continued

| X | Y | Z |
|---|---|---|
| −2.4077 | 0.0108 | 19.9347 |
| −2.4141 | −0.0006 | 19.9347 |
| −2.4161 | −0.0088 | 19.9347 |
| −2.4162 | −0.0130 | 19.9347 |
| −2.4160 | −0.0151 | 19.9347 |
| −2.2907 | −0.0328 | 21.4347 |
| −2.2905 | −0.0338 | 21.4347 |
| −2.2900 | −0.0357 | 21.4347 |
| −2.2887 | −0.0394 | 21.4347 |
| −2.2847 | −0.0462 | 21.4347 |
| −2.2760 | −0.0548 | 21.4347 |
| −2.2567 | −0.0655 | 21.4347 |
| −2.2285 | −0.0731 | 21.4347 |
| −2.1897 | −0.0775 | 21.4347 |
| −2.1410 | −0.0803 | 21.4347 |
| −2.0776 | −0.0825 | 21.4347 |
| −2.0044 | −0.0835 | 21.4347 |
| −1.9263 | −0.0838 | 21.4347 |
| −1.8385 | −0.0839 | 21.4347 |
| −1.7409 | −0.0840 | 21.4347 |
| −1.6335 | −0.0839 | 21.4347 |
| −1.5212 | −0.0839 | 21.4347 |
| −1.4041 | −0.0841 | 21.4347 |
| −1.2821 | −0.0845 | 21.4347 |
| −1.1552 | −0.0849 | 21.4347 |
| −1.0234 | −0.0852 | 21.4347 |
| −0.8867 | −0.0855 | 21.4347 |
| −0.7452 | −0.0858 | 21.4347 |
| −0.5988 | −0.0865 | 21.4347 |
| −0.4523 | −0.0877 | 21.4347 |
| −0.3059 | −0.0894 | 21.4347 |
| −0.1595 | −0.0915 | 21.4347 |
| −0.0131 | −0.0940 | 21.4347 |
| 0.1333 | −0.0968 | 21.4347 |
| 0.2797 | −0.0999 | 21.4347 |
| 0.4261 | −0.1033 | 21.4347 |
| 0.5724 | −0.1070 | 21.4347 |
| 0.7188 | −0.1110 | 21.4347 |
| 0.8652 | −0.1153 | 21.4347 |
| 1.0115 | −0.1199 | 21.4347 |
| 1.1530 | −0.1247 | 21.4347 |
| 1.2896 | −0.1298 | 21.4347 |
| 1.4212 | −0.1351 | 21.4347 |
| 1.5480 | −0.1407 | 21.4347 |
| 1.6699 | −0.1465 | 21.4347 |
| 1.7869 | −0.1526 | 21.4347 |
| 1.8990 | −0.1589 | 21.4347 |
| 2.0013 | −0.1650 | 21.4347 |
| 2.0939 | −0.1710 | 21.4347 |
| 2.1766 | −0.1768 | 21.4347 |
| 2.2497 | −0.1822 | 21.4347 |
| 2.3129 | −0.1873 | 21.4347 |
| 2.3664 | −0.1919 | 21.4347 |
| 2.4121 | −0.1960 | 21.4347 |
| 2.4505 | −0.1995 | 21.4347 |
| 2.4821 | −0.2026 | 21.4347 |
| 2.5074 | −0.2050 | 21.4347 |
| 2.5268 | −0.2069 | 21.4347 |
| 2.5411 | −0.2040 | 21.4347 |
| 2.5508 | −0.1965 | 21.4347 |
| 2.5558 | −0.1880 | 21.4347 |
| 2.5576 | −0.1808 | 21.4347 |
| 2.5574 | −0.1733 | 21.4347 |
| 2.5543 | −0.1638 | 21.4347 |
| 2.5463 | −0.1542 | 21.4347 |
| 2.5327 | −0.1484 | 21.4347 |
| 2.5131 | −0.1458 | 21.4347 |
| 2.4876 | −0.1425 | 21.4347 |
| 2.4558 | −0.1383 | 21.4347 |
| 2.4171 | −0.1331 | 21.4347 |
| 2.3710 | −0.1269 | 21.4347 |
| 2.3171 | −0.1196 | 21.4347 |
| 2.2535 | −0.1106 | 21.4347 |
| 2.1801 | −0.1001 | 21.4347 |
| 2.0970 | −0.0880 | 21.4347 |
| 2.0041 | −0.0742 | 21.4347 |
| 1.9014 | −0.0590 | 21.4347 |
| 1.7890 | −0.0423 | 21.4347 |

TABLE A-continued

| X | Y | Z |
|---|---|---|
| 1.6716 | −0.0250 | 21.4347 |
| 1.5494 | −0.0071 | 21.4347 |
| 1.4222 | 0.0112 | 21.4347 |
| 1.2901 | 0.0299 | 21.4347 |
| 1.1531 | 0.0488 | 21.4347 |
| 1.0111 | 0.0678 | 21.4347 |
| 0.8641 | 0.0867 | 21.4347 |
| 0.7170 | 0.1049 | 21.4347 |
| 0.5699 | 0.1221 | 21.4347 |
| 0.4226 | 0.1383 | 21.4347 |
| 0.2752 | 0.1534 | 21.4347 |
| 0.1277 | 0.1672 | 21.4347 |
| −0.0200 | 0.1796 | 21.4347 |
| −0.1678 | 0.1905 | 21.4347 |
| −0.3159 | 0.1997 | 21.4347 |
| −0.4641 | 0.2070 | 21.4347 |
| −0.6125 | 0.2124 | 21.4347 |
| −0.7610 | 0.2158 | 21.4347 |
| −0.9045 | 0.2167 | 21.4347 |
| −1.0431 | 0.2151 | 21.4347 |
| −1.1767 | 0.2111 | 21.4347 |
| −1.3052 | 0.2045 | 21.4347 |
| −1.4286 | 0.1954 | 21.4347 |
| −1.5469 | 0.1837 | 21.4347 |
| −1.6599 | 0.1698 | 21.4347 |
| −1.7677 | 0.1537 | 21.4347 |
| −1.8652 | 0.1364 | 21.4347 |
| −1.9524 | 0.1181 | 21.4347 |
| −2.0295 | 0.0998 | 21.4347 |
| −2.1011 | 0.0799 | 21.4347 |
| −2.1623 | 0.0600 | 21.4347 |
| −2.2087 | 0.0426 | 21.4347 |
| −2.2447 | 0.0262 | 21.4347 |
| −2.2692 | 0.0097 | 21.4347 |
| −2.2841 | −0.0069 | 21.4347 |
| −2.2895 | −0.0180 | 21.4347 |
| −2.2910 | −0.0258 | 21.4347 |
| −2.2910 | −0.0298 | 21.4347 |
| −2.2908 | −0.0318 | 21.4347 |
| −2.1635 | −0.0473 | 22.9347 |
| −2.1633 | −0.0482 | 22.9347 |
| −2.1629 | −0.0501 | 22.9347 |
| −2.1617 | −0.0536 | 22.9347 |
| −2.1582 | −0.0602 | 22.9347 |
| −2.1507 | −0.0689 | 22.9347 |
| −2.1333 | −0.0804 | 22.9347 |
| −2.1073 | −0.0896 | 22.9347 |
| −2.0711 | −0.0959 | 22.9347 |
| −2.0254 | −0.1008 | 22.9347 |
| −1.9658 | −0.1052 | 22.9347 |
| −1.8969 | −0.1083 | 22.9347 |
| −1.8234 | −0.1103 | 22.9347 |
| −1.7406 | −0.1121 | 22.9347 |
| −1.6487 | −0.1135 | 22.9347 |
| −1.5476 | −0.1144 | 22.9347 |
| −1.4418 | −0.1150 | 22.9347 |
| −1.3315 | −0.1155 | 22.9347 |
| −1.2166 | −0.1156 | 22.9347 |
| −1.0971 | −0.1152 | 22.9347 |
| −0.9730 | −0.1143 | 22.9347 |
| −0.8443 | −0.1129 | 22.9347 |
| −0.7109 | −0.1110 | 22.9347 |
| −0.5730 | −0.1090 | 22.9347 |
| −0.4351 | −0.1071 | 22.9347 |
| −0.2972 | −0.1055 | 22.9347 |
| −0.1593 | −0.1039 | 22.9347 |
| −0.0214 | −0.1023 | 22.9347 |
| 0.1165 | −0.1007 | 22.9347 |
| 0.2544 | −0.0992 | 22.9347 |
| 0.3923 | −0.0978 | 22.9347 |
| 0.5303 | −0.0964 | 22.9347 |
| 0.6682 | −0.0951 | 22.9347 |
| 0.8061 | −0.0939 | 22.9347 |
| 0.9440 | −0.0929 | 22.9347 |
| 1.0773 | −0.0921 | 22.9347 |
| 1.2061 | −0.0916 | 22.9347 |
| 1.3302 | −0.0915 | 22.9347 |
| 1.4497 | −0.0917 | 22.9347 |

TABLE A-continued

| X | Y | Z |
|---|---|---|
| 1.5646 | −0.0924 | 22.9347 |
| 1.6750 | −0.0935 | 22.9347 |
| 1.7807 | −0.0949 | 22.9347 |
| 1.8772 | −0.0967 | 22.9347 |
| 1.9646 | −0.0988 | 22.9347 |
| 2.0427 | −0.1010 | 22.9347 |
| 2.1116 | −0.1034 | 22.9347 |
| 2.1713 | −0.1058 | 22.9347 |
| 2.2218 | −0.1082 | 22.9347 |
| 2.2650 | −0.1105 | 22.9347 |
| 2.3013 | −0.1124 | 22.9347 |
| 2.3311 | −0.1141 | 22.9347 |
| 2.3550 | −0.1156 | 22.9347 |
| 2.3733 | −0.1168 | 22.9347 |
| 2.3868 | −0.1138 | 22.9347 |
| 2.3957 | −0.1066 | 22.9347 |
| 2.4002 | −0.0984 | 22.9347 |
| 2.4017 | −0.0916 | 22.9347 |
| 2.4013 | −0.0846 | 22.9347 |
| 2.3980 | −0.0757 | 22.9347 |
| 2.3901 | −0.0670 | 22.9347 |
| 2.3770 | −0.0622 | 22.9347 |
| 2.3584 | −0.0604 | 22.9347 |
| 2.3343 | −0.0579 | 22.9347 |
| 2.3042 | −0.0548 | 22.9347 |
| 2.2676 | −0.0510 | 22.9347 |
| 2.2241 | −0.0463 | 22.9347 |
| 2.1732 | −0.0407 | 22.9347 |
| 2.1131 | −0.0338 | 22.9347 |
| 2.0437 | −0.0255 | 22.9347 |
| 1.9651 | −0.0158 | 22.9347 |
| 1.8774 | −0.0047 | 22.9347 |
| 1.7804 | 0.0077 | 22.9347 |
| 1.6741 | 0.0213 | 22.9347 |
| 1.5633 | 0.0356 | 22.9347 |
| 1.4478 | 0.0504 | 22.9347 |
| 1.3277 | 0.0656 | 22.9347 |
| 1.2030 | 0.0811 | 22.9347 |
| 1.0736 | 0.0968 | 22.9347 |
| 0.9395 | 0.1126 | 22.9347 |
| 0.8007 | 0.1283 | 22.9347 |
| 0.6619 | 0.1433 | 22.9347 |
| 0.5230 | 0.1573 | 22.9347 |
| 0.3840 | 0.1705 | 22.9347 |
| 0.2449 | 0.1825 | 22.9347 |
| 0.1057 | 0.1933 | 22.9347 |
| −0.0336 | 0.2028 | 22.9347 |
| −0.1731 | 0.2109 | 22.9347 |
| −0.3127 | 0.2173 | 22.9347 |
| −0.4525 | 0.2218 | 22.9347 |
| −0.5924 | 0.2246 | 22.9347 |
| −0.7323 | 0.2254 | 22.9347 |
| −0.8675 | 0.2239 | 22.9347 |
| −0.9980 | 0.2200 | 22.9347 |
| −1.1238 | 0.2138 | 22.9347 |
| −1.2448 | 0.2051 | 22.9347 |
| −1.3608 | 0.1939 | 22.9347 |
| −1.4720 | 0.1804 | 22.9347 |
| −1.5781 | 0.1647 | 22.9347 |
| −1.6792 | 0.1470 | 22.9347 |
| −1.7706 | 0.1282 | 22.9347 |
| −1.8523 | 0.1087 | 22.9347 |
| −1.9244 | 0.0892 | 22.9347 |
| −1.9911 | 0.0682 | 22.9347 |
| −2.0480 | 0.0471 | 22.9347 |
| −2.0909 | 0.0287 | 22.9347 |
| −2.1239 | 0.0114 | 22.9347 |
| −2.1458 | −0.0056 | 22.9347 |
| −2.1586 | −0.0223 | 22.9347 |
| −2.1629 | −0.0332 | 22.9347 |
| −2.1640 | −0.0407 | 22.9347 |
| −2.1639 | −0.0445 | 22.9347 |
| −2.1636 | −0.0464 | 22.9347 |

In the exemplary embodiments, as embodied by the invention, for example an IGV for a compressor, there are many airfoils, which are un-cooled. For reference purposes only, there is established point-0 passing through the intersection of an IGV and the platform along the stacking axis.

Moreover, the IGV, as embodied by the invention, defines a spouting angle into the first compressor rotor stage. This spouting angle defined by the IGV, as embodied by the invention, is an important factor to providing that a compressor meets flow requirements, and proportional output requirements at base load.

It will also be appreciated that the exemplary IGV airfoil(s) disclosed in the above TABLE A may be scaled up or down geometrically for use in other similar compressor designs. Consequently, the coordinate values set forth in TABLE A may be scaled upwardly or downwardly such TABLE A the IGV airfoil profile shape remains unchanged. A scaled version of the coordinates in the TABLE A would be represented by X, Y and Z coordinate values of the TABLE A multiplied or divided by a constant.

In particular, as embodied by the invention, the airfoil as defined by TABLE A, can be applied in a compressor of a turbine, for example, but not limited to, as General Electric "7FA+e" or 7FA.05 compressor. This compressor is merely illustrative of the intended applications for the airfoil, as embodied by the invention. Moreover, it is envisioned that the IGV airfoil of TABLE A, as embodied by the invention, can also be used as an IGV in GE Frame F-class turbines, as well as GE's Frame 6 and 9 turbines, given the scaling of the airfoil, as embodied by the invention.

An IGV airfoil can impart kinetic energy to the airflow and therefore bring about a desired flow across the compressor. The IGV airfoils turn the fluid flow, slow the fluid flow velocity (in the respective airfoil frame of reference), and yield a rise in the static pressure of the fluid flow. The configuration of the IGV airfoil (along with its interaction with surrounding airfoils), as embodied by the invention, including its peripheral surface provides for stage airflow efficiency, enhanced aeromechanics, smooth laminar flow from stage to stage, reduced thermal stresses, enhanced interrelation of the stages to effectively pass the airflow from stage to stage, and reduced mechanical stresses, among other desirable aspects of the invention. Typically, multiple rows of airfoil stages, such as, but not limited to, rotor/stator airfoils, are stacked to achieve a desired discharge to inlet pressure ratio. Airfoils can be secured to wheels or a case by an appropriate attachment configuration, often known as a "root", "base" or "dovetail".

The configuration of an IGV airfoil and any interaction with surrounding airfoils, as embodied by the invention, that provide the desirable aspects fluid flow dynamics and laminar flow of the invention can be determined by various means. Fluid flow from an IGV airfoil, as embodied by the invention, and via the configuration of the instant airfoil, flow over and around subsequent airfoils, as embodied by the invention, is enhanced. In particular, the fluid dynamics and laminar flow from an IGV airfoil, as embodied by the invention, is enhanced. There is a smooth transition fluid flow to any subsequent or downstream airfoils. Moreover, the flow from an IGV, as embodied by the invention, proceeds to the adjacent/downstream airfoil(s) is enhanced due to the enhanced laminar fluid flow off of the IGV airfoil, as embodied by the invention. Therefore, the configuration of the IGV airfoil, as embodied by the invention, assists in the prevention of turbulent fluid flow in the unit comprising the airfoil, as embodied by the invention.

For example, but in no way limiting of the invention, an IGV airfoil configuration (with or without fluid flow interaction) can be determined by computational modeling, Fluid Dynamics (CFD); traditional fluid dynamics analysis; Euler and Navier-Stokes equations; for transfer functions, algorithms, manufacturing: manual positioning, flow testing (for example in wind tunnels), and modification of an IGV; in-situ testing; modeling: application of scientific principles to design or develop the airfoils, machines, apparatus, or manufacturing processes; IGV airfoil flow testing and modification; combinations thereof, and other design processes and practices. These methods of determination are merely exemplary, and are not intended to limit the invention in any manner.

As noted above, the IGV airfoil configuration (along with its interaction with surrounding airfoils), as embodied by the invention, including its peripheral surface provides for airflow efficiency, enhanced aeromechanics, smooth laminar flow from stage to stage, reduced thermal stresses, enhanced interrelation of the stages to effectively pass the IGV airflow from stage to stage, and reduced mechanical stresses, among other desirable aspects of the invention, compared to other similar airfoils, which have like applications. Of course, other such advantages are within the scope of the invention.

While various embodiments are described herein, it will be appreciated from the specification that various combinations of elements, variations or improvements therein may be made by those skilled in the art, and are within the scope of the invention.

What is claimed is:

1. An article of manufacture, the article having a nominal profile substantially in accordance with Cartesian coordinate values of X, Y and Z set forth in TABLE A, and wherein X and Y are distances in inches which, when connected by smooth continuing arcs, define airfoil profile sections at each distance Z in inches, the profile sections at the Z distances being joined smoothly with one another to form a complete inlet guide vane airfoil shape.

2. An article of manufacture according to claim 1, wherein the inlet guide vane airfoil shape comprises an airfoil.

3. An article of manufacture according to claim 2, wherein said airfoil shape lies in an envelope within ±0.160 inches in a direction normal to any article surface location.

4. A compressor comprising a compressor wheel having a plurality of blades, each of said blades cooperating with a plurality of stator vanes, the compressor comprising an inlet guide vane having an airfoil shape, said airfoil shape having a nominal profile substantially in accordance with Cartesian coordinate values of X, Y and Z set forth in TABLE A, wherein X and Y are distances in inches which, when connected by smooth continuing arcs, define the airfoil profile sections at each distance Z in inches, the profile sections at the Z distances being joined smoothly with one another to form a complete inlet guide vane airfoil shape.

5. A compressor comprising a compressor wheel having a plurality of blades, each of said blades cooperating with a plurality of stator vanes, the compressor comprising an inlet guide vane comprising an airfoil having an uncoated nominal airfoil profile substantially in accordance with Cartesian coordinate values of X, Y and Z set forth in TABLE A, wherein X and Y are distances in inches which, when connected by smooth continuing arcs, define airfoil profile sections at each distance Z in inches, the profile sections at the Z distances being joined smoothly with one another to form a complete inlet guide vane airfoil shape, the X and Y distances being scalable as a function of the same constant or number to provide at least one of a scaled up inlet guide vane airfoil and scaled down inlet guide vane airfoil.

6. A compressor according to claim 5 wherein said airfoil shape lies in an envelope within ±0.160 inches in a direction normal to any airfoil surface location.

* * * * *